US006593834B2

(12) United States Patent
Qiu et al.

(10) Patent No.: US 6,593,834 B2
(45) Date of Patent: Jul. 15, 2003

(54) DOUBLE-THROW MINIATURE ELECTROMAGNETIC MICROWAVE SWITCHES WITH LATCHING MECHANISM

(76) Inventors: Cindy Xing Qiu, 6215 Bienville Street, Brossard, Quebec (CA), J4Z 1W6; Chu-Nong Qiu, 6215 Bienville Street, Brossard, Quebec (CA), J4Z 1W6; Yi-Chi Shih, 2220 Thorley Place, Palo Verdes, CA (US) 90274

( * ) Notice: Subject to any disclaimer, the term of this patent is extended or adjusted under 35 U.S.C. 154(b) by 85 days.

(21) Appl. No.: 09/917,052

(22) Filed: Jul. 30, 2001

(65) Prior Publication Data

US 2003/0020561 A1 Jan. 30, 2003

(51) Int. Cl.[7] ..... H01P 1/10
(52) U.S. Cl. ..... 333/262; 333/105
(58) Field of Search ..... 333/262, 105, 333/34, 101; 200/181

(56) References Cited

U.S. PATENT DOCUMENTS 6,016,092 A * 1/2000 Qiu et al. ..... 333/262
6,046,659 A * 4/2000 Loo et al. ..... 333/262
6,310,526 B1 * 10/2001 Yip et al. ..... 333/262

* cited by examiner

*Primary Examiner*—Robert Pascal
*Assistant Examiner*—Dean Takaoka

(57) ABSTRACT

Miniature double-throw electromagnetic microwave switches are disclosed in this invention. In one embodiment a switch comprising an input transmission line, a first movable cantilever with a first permanent magnetic film and connecting to a first output transmission line, a second movable cantilever with a second permanent magnetic film and connecting to a second output transmission line is provided. In another embodiment, a latching function is provided to a miniature double-throw electromagnetic microwave switch by adding a permanent magnetic film to said input transmission line. In yet another embodiment, a third non-movable cantilever with a permanent magnetic film on top is added to said miniature double-throw microwave latching switch to enhance the latching mechanism. In yet another embodiment, a miniature double-throw microwave switch is disclosed where at least one recess contact region for each movable cantilever is provided to reduce the effects of unwanted particles and to reduce the contact resistance by increasing contact pressure. In still another embodiment, a miniature double-throw microwave switch having non-symmetrical movable cantilevers and transmission lines, with tapered or rounded corners is given. This is done in order to minimize the reflection and losses of propagating microwaves or millimeter waves.

16 Claims, 15 Drawing Sheets

Prior Art

Prior Art

DOUBLE-THROW MINIATURE ELECTROMAGNETIC MICROWAVE SWITCHES WITH LATCHING MECHANISM

BACKGROUND OF THE INVENTION

1. Field of the Invention

The invention relates generally to miniature electromagnetic switches for microwave systems. More specifically, the invention relates to a miniature double-throw electromagnetic switch for operation in microwave or millimeter wave frequencies.

2. Description of the Prior Art

Switches are basic building blocks of communication electronics and are widely used for telecommunications applications such as signal routing, redundancy switching, impedance matching networks and adjustable gain amplifiers. Mechanical relay, PIN diode and FET are the common microwave switches. Mechanical relays offer the benefits of low insertion loss, large off-state isolation, high linearity and high power handling capabilities. However, they consume a significant amount of power and are bulky, heavy and slow. Semiconductor switches such as PIN diode and FET provide much faster switching speed and smaller size and weight but are inferior in insertion loss, isolation, linearity and power handling capabilities than mechanical relays.

Microwave switches providing the advantageous properties of both the mechanical relay and semiconductor switch are then highly desirable, especially for space, airborne and mobile telecommunications applications. Micromachining technologies promise to enable the fabrication of such switches, i.e., switches with the high microwave performance of mechanical switches but also with the small size, weight and power consumption of semiconductor switches. Furthermore, conventional microelectronics fabrication processes are usually used for micromachining, making the integration of such miniature switches with other active electronics possible.

In U.S. Pat. No. 6,016,092 entitled "Miniature Electromagnetic Microwave Switches and Switch Arrays" filed on Aug. 8, 1998 by C. X. Qiu, L. S. Yip and Y. C. Shih, single-pole single-throw micro electromagnetic switches in a coplanar waveguide, a microstrip or stripline form were described. A double-throw switch in a stripline form was also described. More recently, in U.S. patent application Ser. No. 09/400,256 entitled "Double-throw Miniature Electromagnetic Microwave Switches" filed on Sep. 21, 1999 by the same inventors of the above U.S. patent, double-throw micro electromagnetic switches in a microstrip form and a coplanar waveguide form and with controlled magnetization are disclosed. These single-pole double-throw switches are useful to the fabrication of microwave modules, which require a plurality of switches for operation at microwave or millimeter wave frequencies.

Two schematic views of a prior art of a miniature double-throw electromagnetic switch (20) disclosed in U.S. patent application Ser. No. 09/400,256 entitled "Double-throw Miniature Electromagnetic Microwave Switches", filed on Sep. 21, 1999 by L. S. Yip, C. X. Qiu and Y. C. Shih, hereinafter called Double-throw Switch A, are shown in FIGS. 1(*a*) and 1(*b*). FIG. 1(*a*) shows a schematic top view of the Double-throw Switch A (20) and FIG. 1(*b*) shows the schematic cross-sectional view of the switch (20) taken along line A–A' in FIG. 1(*a*). The double-throw switch A (20) is fabricated on a dielectric substrate (21) with a ground plane (22 in FIG. 1(*b*)) deposited on backside of the dielectric substrate (21). An input microstrip line (23*a*) and a first output microstrip line (25) are deposited on a front side of the dielectric substrate (21). It is seen that the input microstrip line (23*a*) and the first output microstrip line (25) are aligned in such a way that a continuous microstrip line can be formed when the two are connected electrically. The input microstrip line (23*a*) and the first output microstrip line (25) are separated by a gap (24) having a length, ($L_g$). A first cantilever (23*b*) with a length (26) is deposited over the gap (24) (see FIG. 1(*b*)). A layer of permanent magnetic material (27) is deposited on part of the first cantilever (23*b*). A second output microstrip line (28) having a second cantilever (29) is deposited so that the second cantilever (29) is suspended over the first cantilever (23*b*). The second output microstrip line (28) may be deposited on the same dielectric substrate (21) with the input microstrip line (23*a*) and the first output microstrip line (25), or on a different dielectric substrate. The second cantilever (29) overlaps part of the first cantilever (23*b*) in region without the magnetic film (27) so that when the first cantilever (23*b*) is pushed upwards, a leading portion of the first cantilever (23*b*) can make electrical contact with the second cantilever (29). The overlap between the first cantilever (23*b*) and the first output microstrip line (25) is (36) whereas the overlap between the first cantilever (23*b*) and the second cantilever (29) is (37). A layer of dielectric material (22') such as $SiO_2$ or polyimide is applied on the ground plane (22). A miniature electromagnetic coil (30) is deposited or attached to the dielectric material (22'). Width (31) of the input microstrip line (23*a*) and the first output microstrip line (25) is selected to be substantially equal to the width (32) of the second output microstrip line (28). Values of (31) and (32) are determined by the thickness (33, in FIG. 1(*b*)) of the dielectric substrate (21), the dielectric constant, and the central frequency of the microwave signals to transmit for low loss operation. The second output microstrip line (28) may be arranged so that it makes an angle of roughly 90 degrees with respect to the input microstrip line (23*a*) and the first output microstrip line (25).

The operation of the Double-throw Switch A (20) is as follows. When no current is applied to the miniature electromagnetic coil (30) (I=0), no magnetic force is applied to the first cantilever (23*b*) and the first cantilever (23*b*) is in a normal position in between the first output microstrip line (25) and the second cantilever (29) of the second output microstrip line (28). When a positive current (I>0) is applied to the miniature electromagnetic coil (30), so that the direction of the magnetic field ($B_e$) induced is substantially parallel and opposite to the magnetic moment ($B_m$, in FIG. 1(*b*)) of the permanent magnetic film (27), an attraction force will be caused on the first cantilever (23*b*). When the current (I) exceeds a pull-down threshold or when the force is sufficiently large, the first cantilever (23*b*) will be deformed so that the first cantilever (23*b*), attaching to the input microstrip line (23*a*), will get in contact with the first output microstrip line (25). Microwave signals applying to the input microstrip line (23*a*) will be allowed to reach the first output microstrip line (25). Since there is no electrical contact between the first cantilever (23*b*) and the second cantilever (29), which is connected to the second output microstrip line (28), the incoming microwave signals will not reach the second output microstrip line (28). When the current (I) through the miniature electromagnetic coil (30) is reversed, so that the direction of the magnetic field ($B_e$) induced is substantially parallel and along the magnetic moment ($B_m$) of the permanent magnetic film (27), a repulsion force will be caused on the first cantilever (23*b*). When the reverse current (I) exceeds a push-up threshold or the repulsion force is sufficiently large, the first cantilever (23*b*) will be pushed away from the first output microstrip line (25) and eventually get in contact with the second cantilever (29) connected to the second output microstrip line (28). Microwave signals supplying to the input microstrip line (23*a*) will not be allowed to reach the first output microstrip line (25). Since there is electrical contact between the first cantilever (23*b*) and the second cantilever (29), the incoming microwave signals will reach the second output microstrip line (28). It is consequently clear that the Double-throw Switch A (20) requires continuous supply of current (I) to the micro-coil (30) in order to obtain reliable operation, at least for one of the two operation states.

A second miniature double-throw microwave switch disclosed in U.S. patent application Ser. No. 09/400,256 filed on Sep. 21, 1999 by L. S. Yip, C. X. Qiu and Y. C. Shih, hereinafter called Double-throw Switch B, which is related to this invention is shown in FIGS. 2(*a*) and 2(*b*). FIG. 2(*a*) shows a top view of the Double-throw Switch B (70) on a dielectric substrate (71). FIG. 2(*b*) is the schematic side view of the switch (70) taken along line D–D' in FIG. 2(*a*). The double-throw switch (70) contains a first cantilever (72) and a second cantilever (73). The length of the first cantilever (72) and the second cantilever (73) are chosen to be the same and is given by (26). A first permanent magnetic film (74) is deposited on the first cantilever (72) whereas a second permanent magnetic film (75) is deposited on the second cantilever (73). The first cantilever (72) overlaps part of a first output microstrip transmission line (76) whereas the second cantilever (73) overlaps part of a second output microstrip transmission line (77). Both cantilevers (72, 73) are connected to an input microstrip transmission line (78). Hence one end of the input microstrip transmission line (78) has a first cantilever (72) and the other end has a second cantilever (73). Width (76*a*) of the first output microstrip transmission line (76) is made to be substantially equal to the width (77*a*) of the second output microstrip transmission line (77) and the width (78*a*) of the input microstrip transmission line (78). Values of (76*a*), (77*a*) and (78*a*) for low loss operation are determined by the thickness (84, in FIG. 2(*b*)) of the dielectric substrate (71), the dielectric constant, and the central frequency of the microwave signals to transmit.

As seen in FIG. 2(*b*), the overlap between the first cantilever (72) and the first output microstrip line (76) is (86) and the overlap between the second cantilever (73) and the second output microstrip line (77) is (87). The first output microstrip line (76) and the input microstrip line (78) are separated by a gap (88) whereas the second output microstrip line (77) is separated from the input microstrip line (78) by another gap (89). Also seen in FIG. 2(*b*), a miniature electromagnetic coil (81) is deposited or attach to a dielectric material (82), which is deposited on the ground plane (83).

The operation of the Double-throw Switch B (70) is as follows. Since only one miniature electromagnetic coil (81) is used to actuate the two cantilevers (72, 73), the magnetic polarizations ($B_m$, $B_m'$) on the two permanent magnetic films (74, 75) must be different. When the magnetic polarizations ($B_m$, $B_m'$) are different, preferably opposite, and with a positive current (I) applied to the miniature electromagnetic coil (81), the magnetic field ($B_e$) created will induce attraction force on the second cantilever (73) and a repulsion force on the first cantilever (72), causing contact of the second cantilever (73) with the second output microstrip line (77) while causing an open between the first cantilever (72) and the first output microstrip line (76). Hence microwave signals incident from the input microstrip line (78) will be allowed to go through the second cantilever (73) to reach the second output microstrip line (77). Since there is no electrical contact of the input microstrip line (78) with the first output microstrip line (76), microwave signals will not be coupled from the input microstrip line (78) to the first output microstrip line (76). When the current (I) applied to the miniature electromagnetic coil (81) is reversed, the magnetic field ($B_e$) from the miniature electromagnetic coil (81) will be inverted to induce a repulsion force on the second cantilever (73) and an attraction force on the first cantilever (72), causing contact between the first cantilever (72) and the first output microstrip line (76) while causing an open between the second cantilever (73) and the second output microstrip line (77). Hence, when the current (1) is inverted, microwave signals incident from the input microstrip transmission line (78) will be allowed to go through the first cantilever (72) to reach the first output microstrip line (76). Since there is no electrical contact between the second cantilever (73) and the second output microstrip transmission line (77), microwave signals will not be coupled from the input microstrip transmission line (78) to the second output microstrip transmission line (77).

Although the Double-throw Switch B (70) may operates at a moderate microwave frequencies, when the first cantilever (72) is actuated to make contact with the first output transmission line (76) the open second cantilever (73) connected to the input microstrip transmission line (78) will act as an antenna and result in unwanted reflection and losses of the incident microwave signals at higher frequencies. This is because the length (26) of the second cantilever can't be made too small compared with wavelength of the microwaves signal at high frequencies.

SUMMARY OF THE INVENTION

The present invention allows the fabrication of miniature electromagnetic double-throw switches based on the micromachining technologies to minimize RF losses and to increase the RF frequencies of operation. The present invention also allows the switches to have latching mechanism to minimize the power consumption of the double-throw switches.

In one embodiment of this invention, a double-throw miniature microwave switch with a dielectric substrate, an input transmission line, a first movable cantilever and a second movable cantilever each with a permanent magnetic film is provided. Said first movable cantilever forms part of a first output transmission line whereas said second movable cantilever forms part of a second output transmission line. When actuated by a magnetic field in one direction, said first movable cantilever moves downwards to cause contact between said input transmission line and said first output transmission line whereas said second movable cantilever moves upwards to isolate said second output transmission line from said input transmission line. When the direction of said actuation magnetic field is reversed, said first movable cantilever moves upwards to cause an isolation between said input transmission line and said first output transmission line whereas said second movable cantilever moves downwards to cause contact between said input transmission line and said second output transmission line.

In another embodiment, a double-throw miniature microwave switch with recess contact regions is provided. The presence of un-wanted particles on the substrate is unavoidable and those under the movable cantilevers in a switch may increase the contact resistance and reduce the contact pressure. By creating at least one recess contact region for each movable cantilever, the effect of said unwanted particles can be reduced and the contact pressure can be increased to give rise to a reduced contact resistance.

In yet another embodiment, a double-throw miniature microwave switch, having non-symmetrical movable cantilevers and transmission lines with tapered or rounded corners is given. Sharp corners in transition between the input transmission line and the output transmission line are eliminated in this switch to minimize the reflection and losses of propagating microwaves or millimeter waves.

In yet another embodiment, a double-throw miniature microwave switch with latching is given. Said switch consists of a dielectric substrate, an input transmission line, a first output transmission line with a first movable cantilever and a second output transmission line with a second movable cantilever. At least part of said input transmission line, part of said first movable cantilever and part of said second movable cantilever are covered with permanent magnetic films. Magnetization of said permanent magnetic films is controlled to allow latching in one state to occur when said switch is actuated so that said first movable cantilever moves towards said input transmission line, arising from an external magnetic field. Latching between said first movable cantilever and said input transmission line occurs due to a magnetic attracting force between said permanent magnetic films in said first movable cantilever and in said input transmission line. Hence, microwaves from said input transmission line is allowed to propagate to said first output transmission line but not allowed to propagate to said second output transmission line. Latching will also occurs in another state when said switch is actuated so that said second movable cantilever moves towards said input transmission line, arising from a reversed external magnetic field. Latching between said second movable cantilever and said input transmission line occurs due to a magnetic attracting force between said permanent magnetic films in said second movable cantilever and in said input transmission line. In this case, microwave signals from said input transmission line will be allowed to propagate to said second output transmission line but will not be allowed to propagate to said first output transmission line.

In yet another embodiment, a double-throw miniature microwave switch with latching is given. Said switch consists of a dielectric substrate, an input transmission line, a first output transmission line with a first movable cantilever, a second output transmission line with a second movable cantilever and a third non-movable cantilever for latching. At least part of said input transmission line, part of said first movable cantilever, part of said second movable cantilever and part of said third non-movable cantilever are covered with permanent magnetic films. Magnetization of said permanent magnetic films is controlled to allow latching in one state to occur when said switch is actuated so that said first movable cantilever moves towards said input transmission line, arising from an external magnetic field. Latching between said first movable cantilever and said input transmission line occurs due to a magnetic attracting force between said permanent magnetic films in said first movable cantilever and in said input transmission line. Magnetization of said permanent magnetic films is also controlled to allow latching in this state to occur when said switch is actuated so that said second movable cantilever moves towards said third non-movable cantilever, arising from said external magnetic field. Latching between said second movable cantilever and said third non-movable cantilever occurs due to a magnetic attracting force between said permanent magnetic films in said second movable cantilever and in said third non-movable cantilever. Hence, microwaves from said input transmission line is allowed to propagate to said first output transmission line but not allowed to propagate to said second output transmission line. Latching will also occurs in another state when said switch is actuated so that said first movable cantilever moves towards said third non-movable cantilever and gets latched, whereas said second movable cantilever moves towards said input transmission line and gets latched. In this case, microwave signals from said input transmission line will be allowed to propagate to said second output transmission line but will not be allowed to propagate to said first output transmission line.

In still another embodiment, a double-throw miniature microwave switch with latching mechanism and a smooth transition region is given. Said switch consists a dielectric substrate, an input transmission line with a movable cantilever, a first output transmission line and a second output transmission line with a non-movable cantilever. At least part of said movable cantilever, said non-movable cantilever and said first output transmission line are covered with permanent magnetic films. Magnetization of said permanent magnetic films is controlled to allow latching in one state to occur when said switch is actuated so that said movable cantilever moves towards said first output transmission line, arising from an external magnetic field. Latching between said movable cantilever and said first output transmission line occurs due to a magnetic attracting force between said permanent magnetic films in said movable cantilever and in said first output transmission line. Hence, microwaves from said input transmission line is allowed to propagate to said first output transmission line but not allowed to propagate to said second output transmission line connecting to said non-movable cantilever. Latching in another state will be allowed to occur when said switch is actuated so that said movable cantilever moves towards said non-movable cantilever connecting to said second output transmission line, arising from a reversed external magnetic field. Latching between said movable cantilever and said non-movable cantilever occurs due to a magnetic attracting force between said permanent magnetic films in said movable cantilever and in said non-movable cantilever connecting to said second output transmission line. In this case, microwave signals from said input transmission line will be allowed to propagate to said second output transmission line but will not be allowed to propagate to said first output transmission line. Since sharp corners in the transition region between the input transmission line and the output transmission lines are eliminated in this switch, the reflection and losses of propagating microwaves or millimeter waves are minimized.

BRIEF DESCRIPTION OF THE DRAWINGS

FIGS. 11(*c*) and 11(*d*) show the switch with a different magnetization for the permanent magnetic films.

FIG. 12(*c*) shows the switch equipped with latching mechanism and (*d*) shows the switch completed with a double-sided recess region to increase the contact pressure and to minimize detrimental effect of the presence of the unwanted particles.

DETAILED DESCRIPTION OF THE PREFERRED EMBODIMENTS

For microwave applications, the switches used may base on resistive coupling or capacitive coupling. To simplify the description, miniature electromagnetic switches based on a resistive coupling will be used in the following description. It is understood that switches based on capacitive coupling may as well be constructed and fabricated using the structures to be described in this invention. In addition, microwave switches in a microstrip transmission line form or a coplanar transmission line form may be used. To simplify the explanation, switches in a microstrip transmission line form will be used for the description. It is understood that switches based on the coplanar transmission line form may as well be constructed and fabricated using the structures to be described in this invention.

Figure 3A:
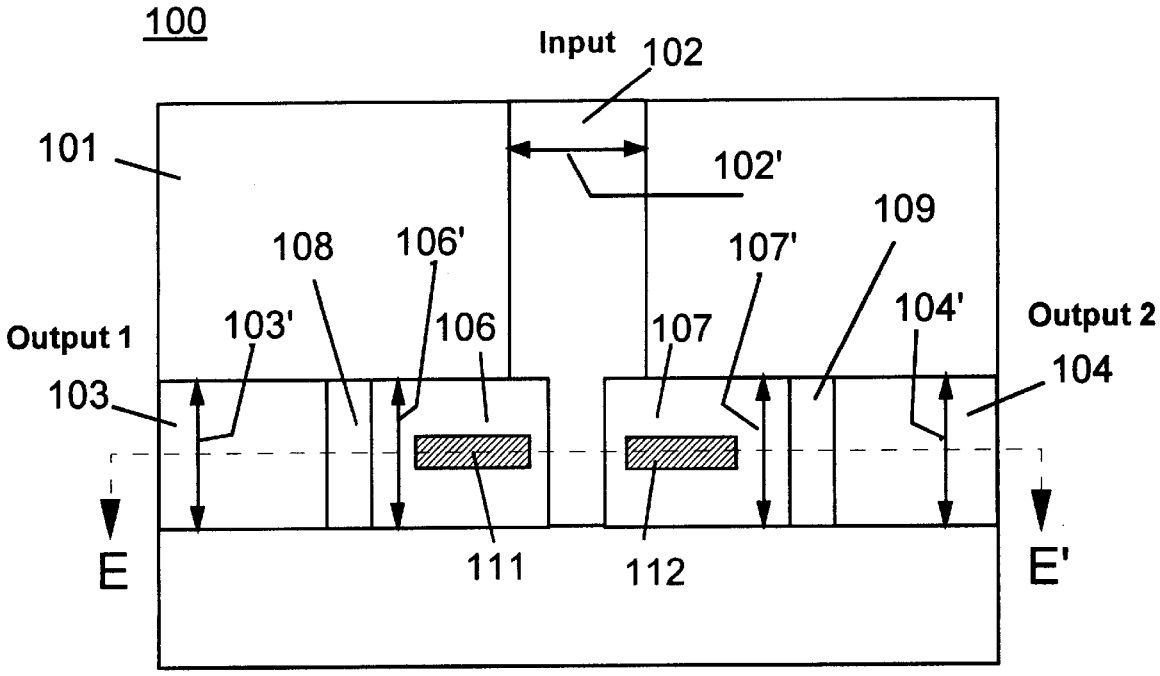
FIG. 3(*a*) A schematic top view of a double-throw miniature microwave switch (100) containing an input transmission line, a first cantilever connected to a first output transmission line with a first permanent magnetic film, and a second cantilever connected to a second output transmission line with a second permanent magnetic film. (*b*) A schematic cross-sectional view of the switch (100) taken along the line E–E' in FIG. 3(*a*).
Figure 3B:
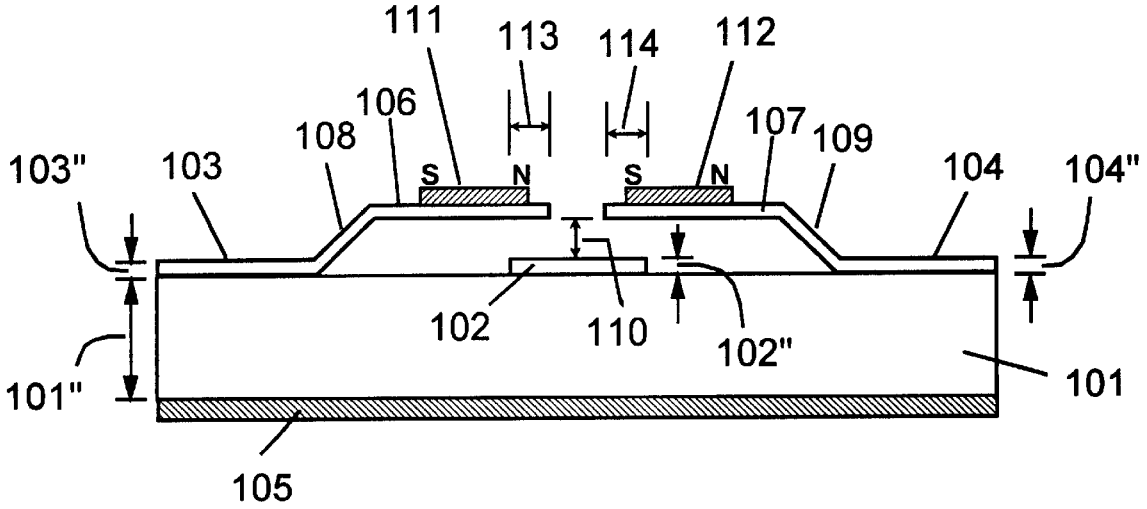

According to one embodiment of this invention, as shown in FIG. 3(*a*), a double-throw miniature microwave switch (100), hereinafter called Double-throw Switch C (100) is constructed on a front side of a dielectric substrate (101) with an input transmission line (102) having a width (102'), a first output transmission line (103) having a width (103') and a second output transmission line (104) having a width (104'). FIG. 3(*b*) shows the cross-sectional view of the Double-throw Switch C (100) taken along the line E–E' of FIG. 3(*a*), which gives a top view of the Double-throw Switch C (100). As shown in FIG. 3(*b*), the Double-throw Switch C (100) is fabricated on the dielectric substrate (101) with a thickness (101") having a ground plane (105) deposited on a backside of the dielectric substrate (101). Thickness of the ground plane is in a range from 0.3 $\mu$m to 10 $\mu$m, dependent on the skin depth of the microwave signals to operate. The transmission lines (102, 103, 104), with thicknesses (102", 103", 104"), are made using metals such as Au, Cu, Ti and W and combinations of them. The widths (102', 103', 104', in FIG. 3(*a*)) are the same and are selected according to the frequencies of operation, characteristic impedance, thickness and dielectric constant of the substrate (101). When an alumina substrate is used, the widths (102', 103', 104') of the input and output transmission lines (102, 103 and 104) will be approximately equal to the thickness of the alumina substrate.

As shown in FIG. 3, a first movable cantilever (106) and a second movable cantilever (107) are deposited to connect to the first output transmission line (103) and the second output transmission line (104) respectively. A first inclined portion (108) raises the first movable cantilever (106) by a separation (110, in FIG. 3(*b*)) from the input transmission line (102) while a second inclined portion (109) raises the second movable cantilever (107) by the same separation (110). A first permanent magnetic film (111) is deposited on a front surface of the first movable cantilever (106) and a second permanent magnetic film (112) is deposited on a front surface of the second movable cantilever (107). The two permanent magnetic films (111, 112) are magnetized in such a way so that the magnetic polarization of (111, 112) is in the same direction (as marked by S and N in FIG. 3(*b*)). The first movable cantilever (106) is fabricated so that the projection of (106) makes an overlap (113) with the input transmission line (102). Similar, the second movable cantilever (107) is fabricated so that the projection of (107) makes an overlap (114) with the input transmission line (102). The amount of overlaps (113, 114) is determined by the desired minimum parasitic capacitances required for the overlapped regions when cantilevers (106, 107) are not in contact with the input transmission line (102). It is obvious that for fixed values of separation (110) and widths (106', 107'), the parasitic capacitance values are directly proportional to the amount of overlaps (113, 114). As a general rule, the amount of overlaps (113, 114) is selected to be as small as possible providing a good electrical contact between the movable cantilevers (106, 107) and the input transmission line (102) is ensured.

Figure 4A:
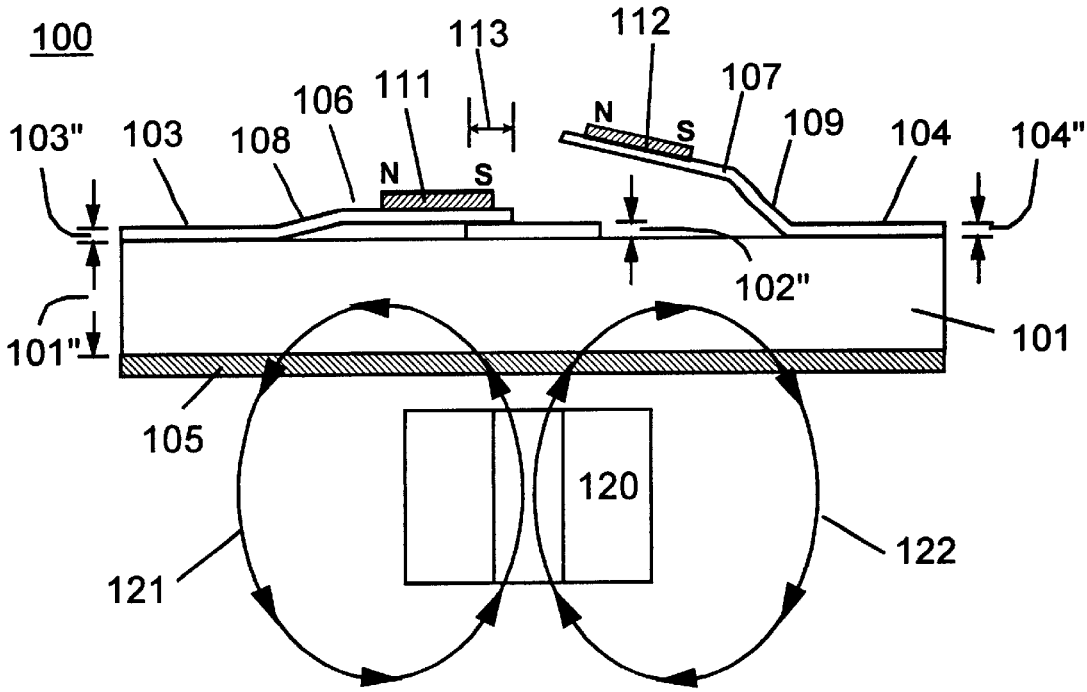
FIG. 4 Schematic cross-sectional views of the double-throw miniature microwave switch (100) illustrated in FIG. 3, demonstrate the switch in actuation, (*a*) for the case when an actuation current is applied to the electromagnet, the first cantilever is pulled down to make electrical contact with the input transmission line and the second cantilever is pushed up and (*b*) for the case when an actuation current with an opposite direction is applied to the electromagnet, the second cantilever is pulled down to makes electrical contact with the input transmission line and the first cantilever is pushed up.
Figure 4B:
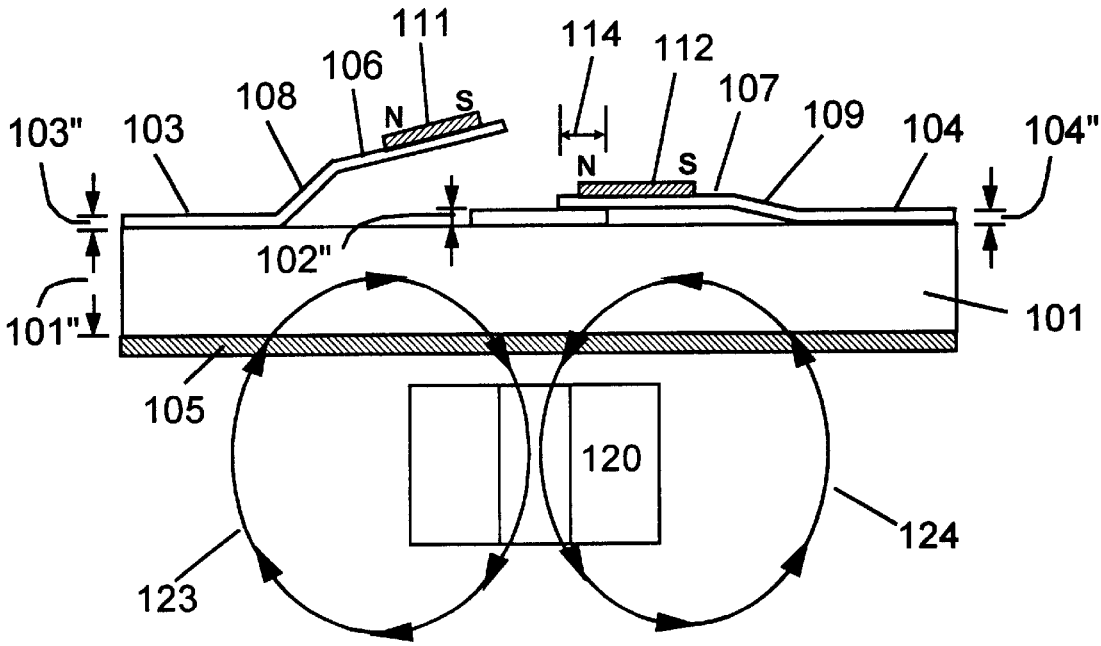

The operation of the Double-throw Switch C (100) disclosed in FIG. 3 is illustrated in FIG. 4. In FIGS. 4(*a*) and 4(*b*), an electromagnet (120) is placed under the Double-throw Switch (100). As shown in FIG. 4(*a*), when a dc current is applied to the electromagnet (120), the magnetic flux generated (121, 122) points away from the electromagnet (120) at the top of the electromagnet (120). Due to the magnetic flux (121) going through the first permanent magnetic film (111), the first permanent magnetic film (111) will be attracted towards the electromagnet (120), so that the leading end of the first movable cantilever (106) will get in touch with the input transmission line (102). Since the magnetization of the two permanent magnetic films (111, 112) are in the same direction (pointing from N to S) and the direction of the magnetic flux (122) going through the second permanent magnetic film (112) is opposite to that experienced by the first permanent magnetic film (111), the second permanent magnetic film (112) will experience a repulsion force and the second movable cantilever (107) will be pushed away from the input transmission line (102). Hence, microwave signals applied to the input transmission line (102) will be directed towards the first output transmission line (103). As shown in FIG. 3(*a*), the microwave-propagating path including the input transmission line (102), the first movable cantilever (106) and the first output transmission line (103) has a uniform value for (102', 106', 103'). Hence, the reflection and losses of propagating microwaves can be minimized.

When the direction of the dc current to the electromagnet (120) is reversed, the magnetic flux generated (123, 124 in FIG. 4(*b*)) will reverse. In this case, as shown in FIG. 4(*b*), the first permanent magnetic film (111) will experience a repulsion force and the first movable cantilever (106) will be pushed away from the input transmission line (102). Whereas the second permanent magnetic film (112) will experience an attracting force and the second movable cantilever (107) will be attracted to make contact with the input transmission line (102). Microwave signals applied to the input transmission line (102) will now be directed towards the second output transmission line (104). As shown in FIG. 3(*a*), the widths (102', 107', 104') of the microwave-propagating path including the transmission line (102), the second movable cantilever (107) and the second output transmission line (104) are uniform. Hence, the reflection and losses of propagating microwaves can be minimized.

Figure 1A:
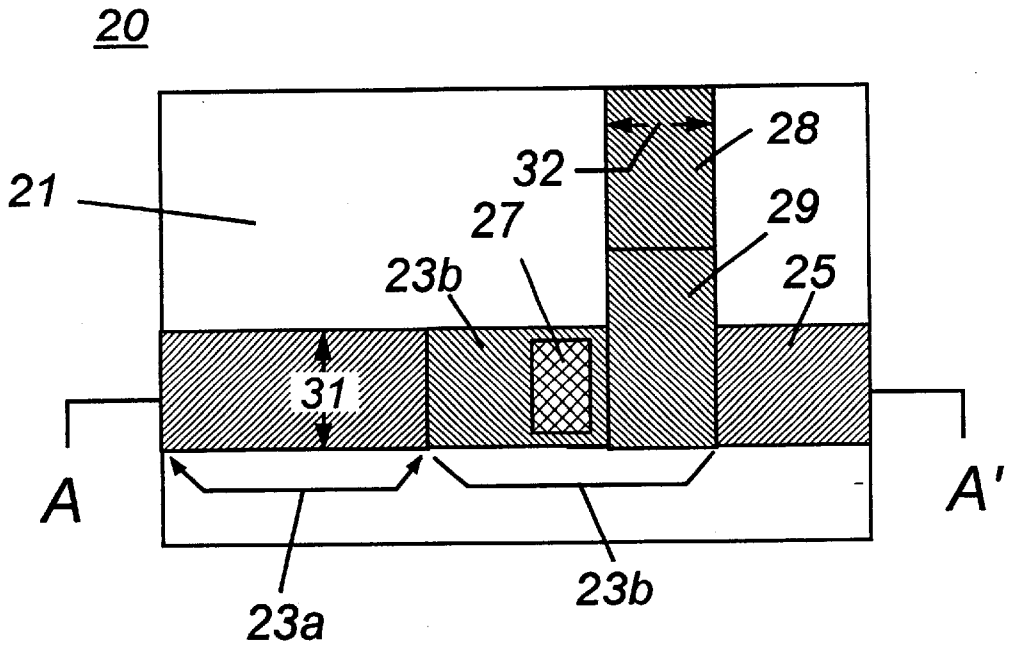
Fig. 1(a) Prior Art
FIG. 1(*a*) A schematic top view of a prior art showing the Double-throw Switch A (20) fabricated on a dielectric substrate. (*b*) A schematic cross-sectional view of the prior art double-throw microwave switch (20) taken along the line A–A' in FIG. 1(*a*).
Figure 1B:
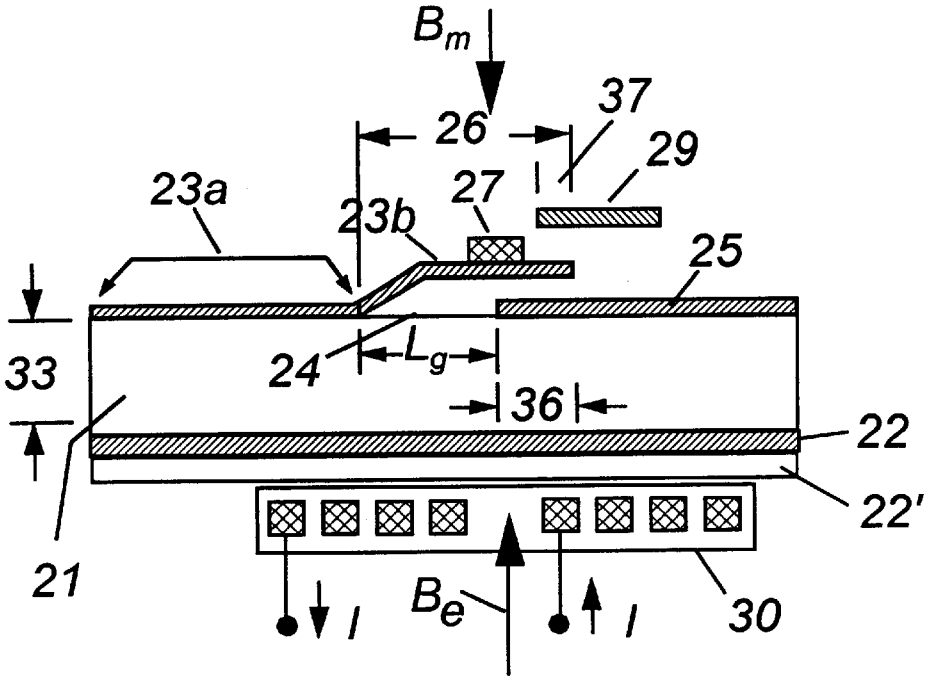
Figure 2A:
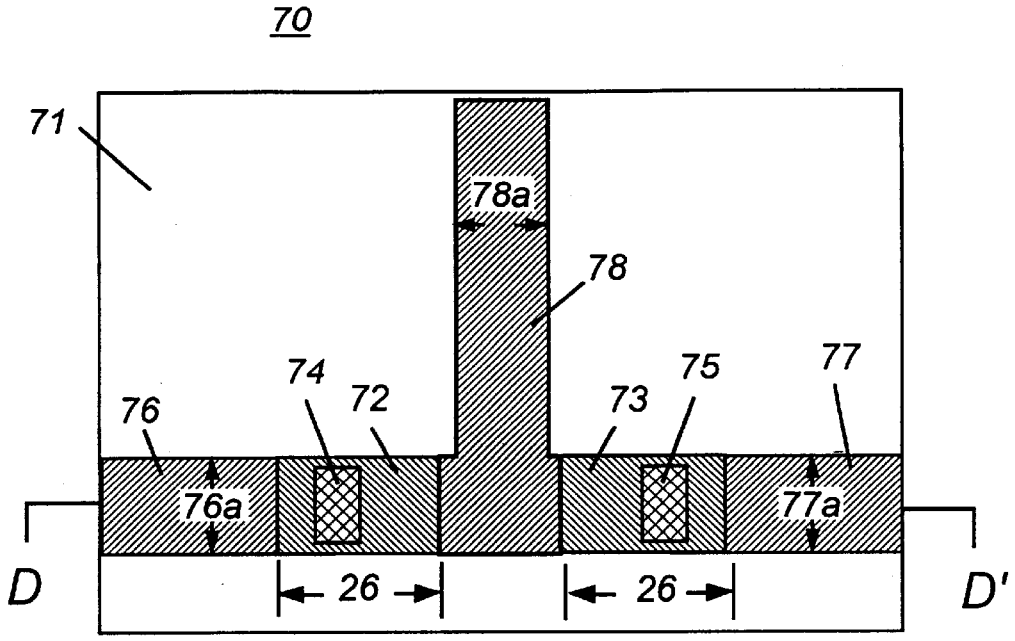
Fig. 2(a) Prior Art
FIG. 2(*a*) A schematic top view of a prior art showing the Double-throw Switch B (70) containing a first cantilever with a first permanent magnetic film and a second cantilever with a second permanent magnetic film and (*b*) a schematic cross-sectional view of the prior art miniature Double-throw Switch B (70) taken along the line D–D' in FIG. 2(*a*).
Figure 2B:
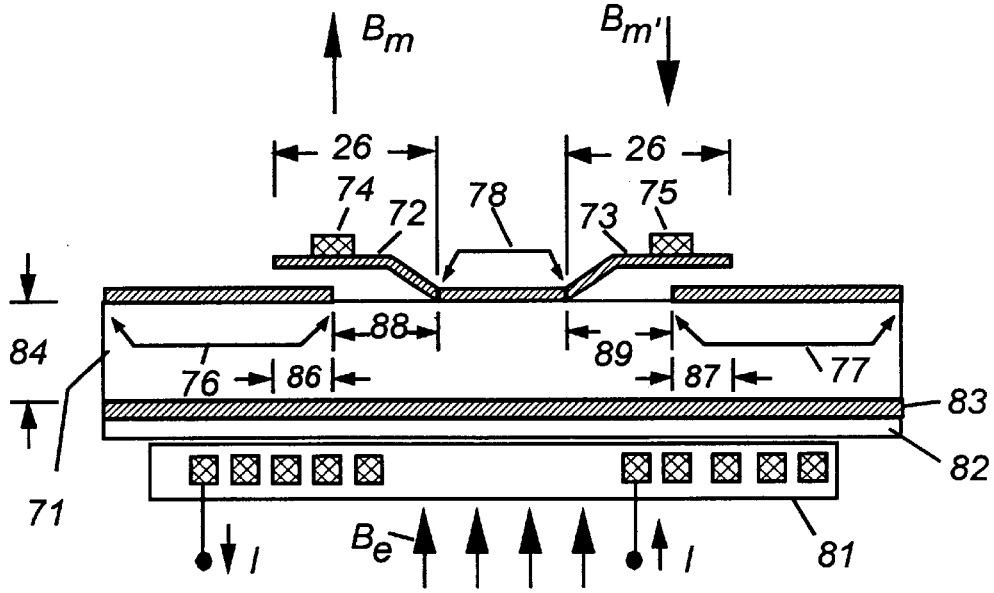

Although Double-throw Switch C (100) with horizontal magnetization for (111) and (112) are described, it should be noted that a vertical magnetization, similar to Double-throw Switches B (See FIG. 2(*b*)) in prior art, could be used in the Double-throw Switch C (100) as well. In such a case, the magnetization for the first permanent magnetic film (111) and the second permanent magnetic film (112) should be opposite to each other so that when the first permanent magnetic film (111) is experiencing an attracting force, the second permanent magnetic film (112) will experience a repulsing force. Therefore, it is understood that Double-throw Switch C (100) with vertical magnetizations might as well be constructed and fabricated using the structures described in this invention.

Figure 5A:
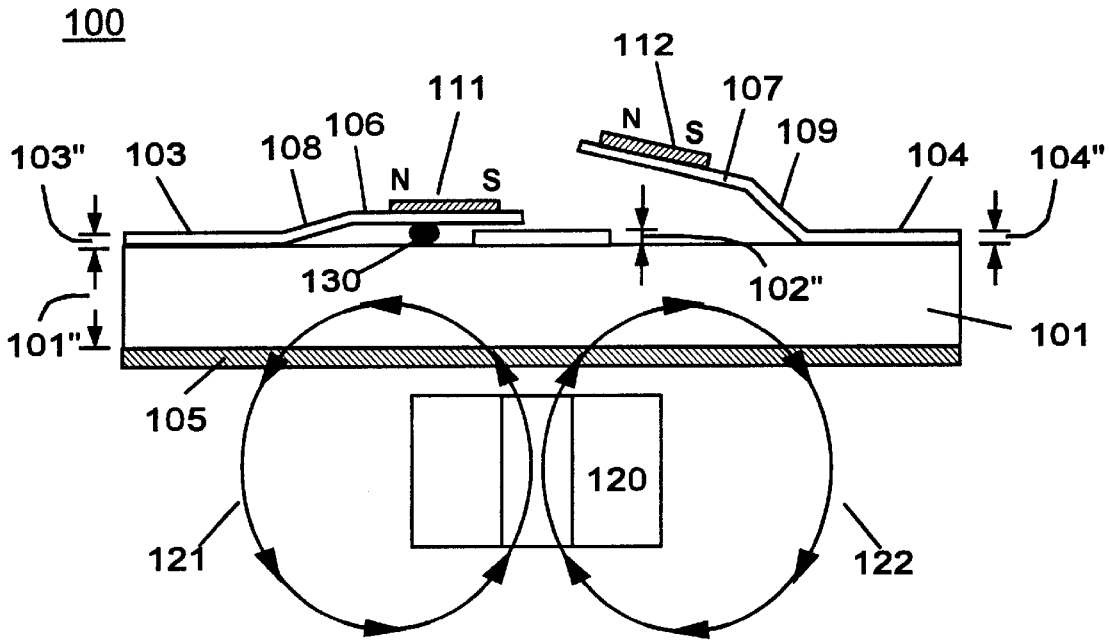
FIG. 5 Schematic cross-sectional views of the double-throw miniature microwave switch (100) in actuation, (*a*) shows the case when un-wanted particle present between the first cantilever and the substrate and (*b*) illustrates the case when unwanted particle present between the first cantilever and the input transmission line, resulting in electrical contact breaking between the first cantilever and the input transmission line.
Figure 5B:
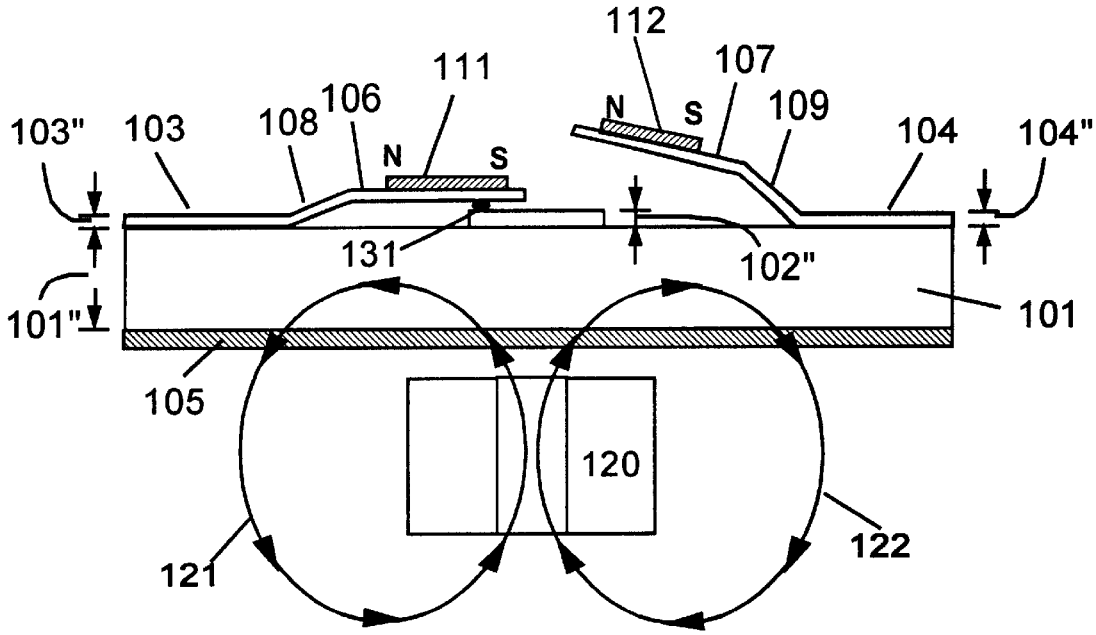

During the operation of the Double-throw Switch C (100), certain particles may be present due to contamination or releasing of particles from the substrate and the packaging materials. FIG. 5(*a*) shows the effects of the presence of a particle (130) between the substrate (101) and the first movable cantilever (106) for the Double-throw Switch C (100) illustrated in FIG. 4(*a*). If the dimension of the particle (130) is greater than the thickness (102") of the input transmission line (102), then the first movable cantilever (106) will not be able to make sufficient electrical contact to the input transmission line (102). Hence the contact impedance will be high. In the case of a unwanted particle (131) existing on a front surface of the input transmission line (102) in the contact region (see FIG. 5(*b*)), the first movable cantilever (106) will not make a good contact with the input transmission line (102) regardless the dimension of the particle (130).

In addition to the effects of the unwanted particles, one may need to increase the contact pressure to ensure proper electrical contact between a movable cantilever (106 or 107) and the input transmission line (102). For the flat cantilevers shown in FIG. 3, 4, and 5, the first and second movable cantilevers (106, 107) will make a contact to the input transmission line (102) without the presence of unwanted particles. However, these contacts will be spread over a large area. Furthermore, the movable cantilevers (106, 107) may make contacts to the substrate in areas outside the input transmission line (102). In such a case, the contact pressure for a fixed actuation force will be significant reduced leading to poor electrical contacts.

Figure 6A:
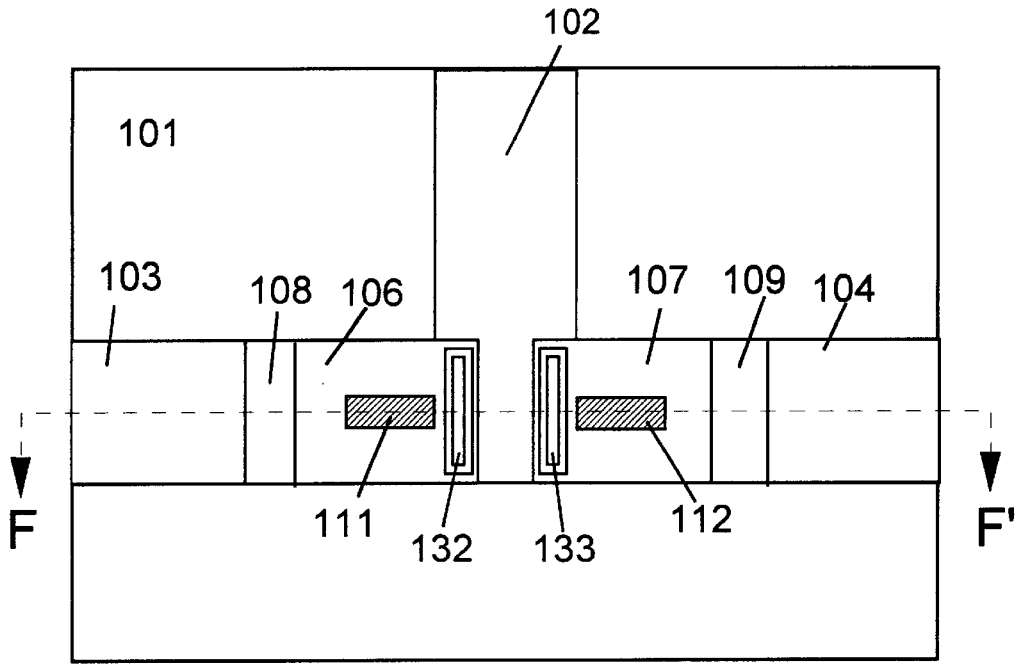
FIG. 6(*a*) shows a schematic top view of a double-throw miniature microwave switch having a recess region on a first cantilever in the overlap region between the first cantilever and an input transmission line. The switch also has a recess region on the second cantilever in the overlap region of the second cantilever and the input transmission line to increase the contact pressure and to minimize detrimental effect of the presence of unwanted particles. (*b*) A schematic cross-sectional view of the microwave switch taken along the line F–F' in FIG. 6(*a*), showing the location and arrangement of the recess regions in the cantilevers.
Figure 6B:
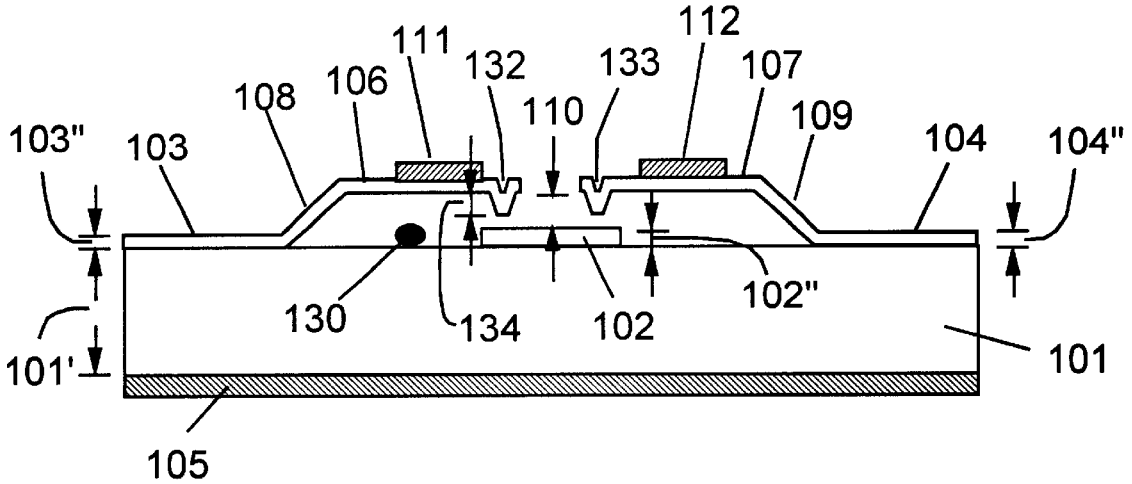

In order to minimize the effects of the unwanted particles and to increase the contact pressure in Double-throw Switch C (100), a structure with recess regions in the movable cantilevers (106, 107) is provided. As shown in FIGS. 6(*a*) and (*b*), a first recess region (132) is created in the first movable cantilever (106) in area overlapping the input transmission line (102) and a second recess region (133) is created in the second movable cantilever (107) in area overlapping the input transmission line (102). Other parts of the Double-throw Switch C (100) are kept to be the same as the one described in FIGS. 3, 4, and 5. As shown in FIG. 6(*b*), a side-view taking along line F–F' in FIG. 6(*a*), the height (134) of the recess regions (132, 133) is controlled during the fabrication and may be in the range from 1 to 20 $\mu$m. During the operation, when the first movable cantilever (106) is actuated, the unwanted particle (130) on the substrate (101) will not get in touch with the first movable cantilever (106). Hence, unlike in the case of FIG. 5(*a*), the presence of the unwanted particles will not have significant effect on the operation of the Double-throw Switch C (100). Furthermore, since the contact area of the movable cantilevers (106, 107) when actuated, is much less compared to the case without the recess regions (132, 133), the contact pressure will be increased even with the same actuation force. With the recess regions (132, 133) in the cantilevers (106, 107), the contact resistance during the operation then will decrease.

Figure 7A:
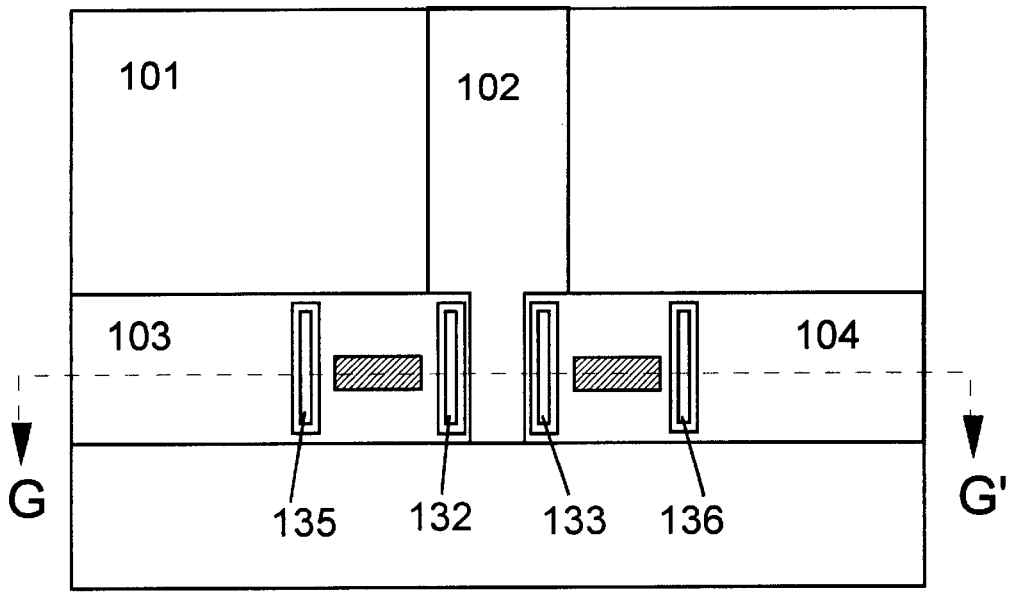
FIG. 7(*a*) A schematic top view of a double-throw miniature microwave switch showing recess regions in a first cantilever both in and outside the overlap region of the first cantilever and the input transmission line and recess regions in a second cantilever both in and outside the overlap region of the second cantilever and the input transmission line to increase the contact pressure and to minimize detrimental effect of the presence of unwanted particles. (*b*) A schematic cross-sectional view of the microwave switch taken along the line G–G' in FIG. 7(*a*), showing the location and arrangement of the recess regions in the cantilevers.
Figure 7B:
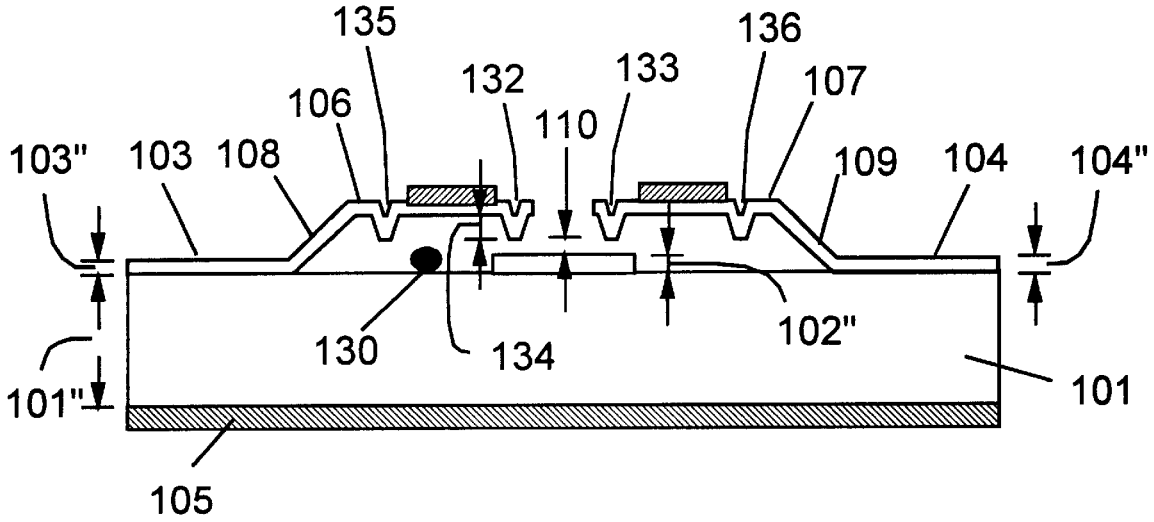

The operation may be improved further by creating more than one recess region in each movable cantilever. With a single recess region in each movable cantilever, the movable cantilevers (106, 107) still can get in touch with the substrate (101) when actuated, leading to a reduced pressure. To overcome this, two recess regions may be created for each movable cantilever as shown in FIGS. 7(*a*) and 7(*b*), a cross-sectional view of the switch taking along line G–G' in FIG. 7(*a*). Here, it can be seen that in addition to the first recess region (132), a third recess region (135) has been created in the first movable cantilever (106). Whereas for the second movable cantilever (107), a fourth recess region (136) has been created in addition to the second recess region (133). When actuated, the two recess regions for each movable cantilever will get in touch with the substrate (101) and the input transmission line (102). Hence, the effects of unwanted particles can be reduced and the pressure can be increased.

Figure 8A:
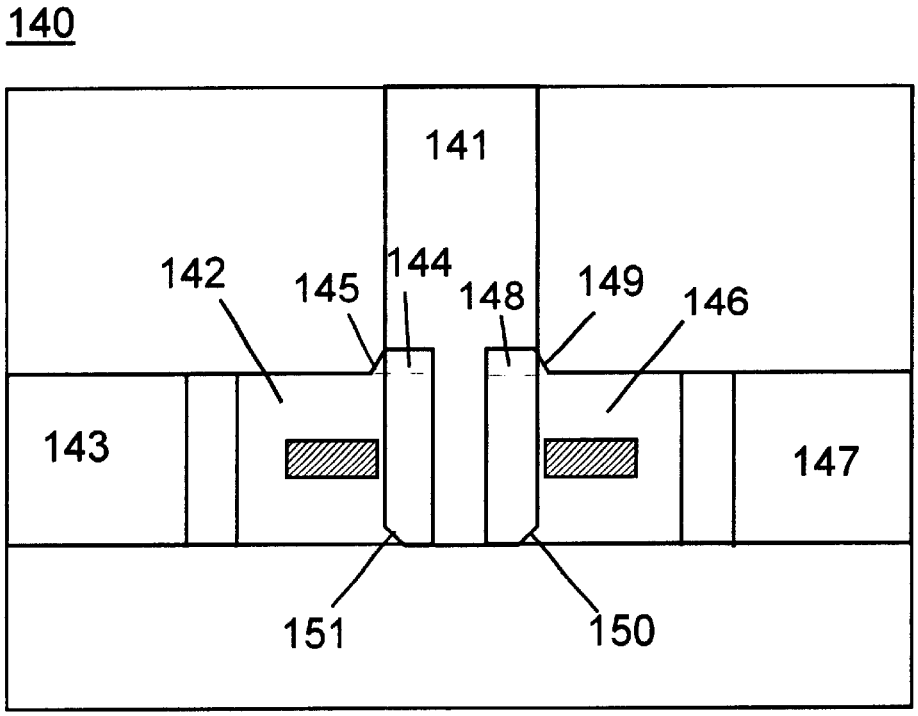
FIG. 8(*a*) illustrates a schematic top view of a double-throw miniature microwave switch having an input transmission line with tapered corners, a first non-symmetrical cantilever and a second non-symmetrical cantilever each with a tapered inner corner with the input transmission line, to minimize reflection and losses of propagating microwaves or millimeter waves. (*b*) A schematic top view of a double-throw miniature microwave switch having an input transmission line with rounded corners, a first non-symmetrical cantilever and a second non-symmetrical cantilever each with a rounded inner corner with the input transmission line, to minimize reflection and losses of propagating microwaves or millimeter waves.
Figure 8B:
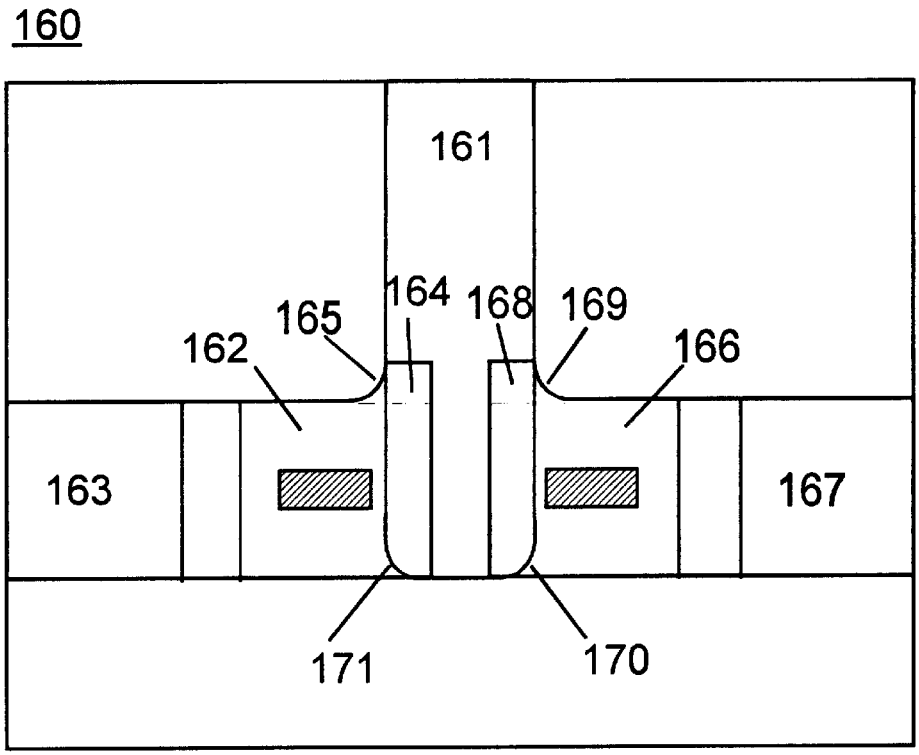

For the switching of microwave signals at very high frequencies, such as more than 10 GHz, it is required to have more uniform and streamline distribution of the width of the microwave-propagating path, even in the transition region where the input transmission line makes contact with an actuated movable cantilever. One structure of the double-throw miniature microwave switch (140), having a tapered input transmission line (141) and two nonsymmetrical movable cantilevers, to achieve this is shown in FIG. 8(*a*). The first nonsymmetrical movable cantilever (142) connecting to a first output transmission line (143) has a protruding region (144) so that the inner angle (145) it makes with the input transmission line (141) when actuated will not be abrupt. The second nonsymmetrical movable cantilever (146) connecting to a second output transmission line (147) has a protruding region (148) so that the inner angle (149) it makes with the input transmission (141) when actuated will not be abrupt. Furthermore, the corners (150, 151) of the input transmission line (141) are tapered. When the first nonsymmetrical movable cantilever (142) is actuated to make electrical contact with the input transmission line (141) and with the second nonsymmetrical movable cantilever (146) being pushed away from the input transmission line (141), microwave signals will propagate from the input transmission line (141) through the contact region towards the first output transmission line (143). Due to the smoothed inner angle (145) and the tapered corner (150) of the input transmission line (141), the reflection and losses for the propagating microwaves will be minimized. When the second nonsymmetrical movable cantilever (146) is actuated to make electrical contact with the input transmission line (141) and with the first nonsymmetrical movable cantilever (142) being pushed away from the input transmission line (141), microwave signals will propagate from the input transmission line (141) through the contact region towards the second output transmission line (147). Due to the smoothed inner angle (149) and the tapered corner (151) of the input transmission line (141), the reflection and losses for the propagating microwaves will be minimized.

Another structure of the double-throw miniature microwave switch to achieve this purpose is shown in FIG. 8(*b*). The switch (160) has an input transmission line (161) with rounded corners and two nonsymmetrical movable cantilevers. The first nonsymmetrical movable cantilever (162) connecting to a first output transmission line (163) has a protruding region (164) so that the inner angle (165) it makes with the input transmission line (161) when actuated will have a rounded transition and will not be abrupt. The second nonsymmetrical movable cantilever (166) connecting to a second output transmission line (167) has a protruding region (168) so that the inner angle (169) it makes with the input transmission (161) when actuated will have a rounded transition and will not be abrupt. Furthermore, the corners (170, 171) of the input transmission line (161) are rounded. When the first nonsymmetrical movable cantilever (162) is actuated to make electrical contact with the input transmission line (161) and with the second nonsymmetrical movable cantilever (166) being pushed away from the input transmission line (161), microwave signals will propagate from the input transmission line (161) through the contact region towards the first output transmission line (163). Due to the rounded inner angle (165) and the rounded corner (170) of the input transmission line (161), the reflection and losses for the propagating microwaves will be minimized. When the second nonsymmetrical movable cantilever (166) is actuated to make electrical contact with the input transmission line (161) and with the first nonsymmetrical movable cantilever (162) being pushed away from the input transmission line (161), microwave signals will propagate from the input transmission line (161) through the contact region towards the second output transmission line (167). Due to the rounded inner angle (169) and the rounded corner (171) of the input transmission line (161), the reflection and losses for the propagating microwaves will be minimized.

Figure 9A:
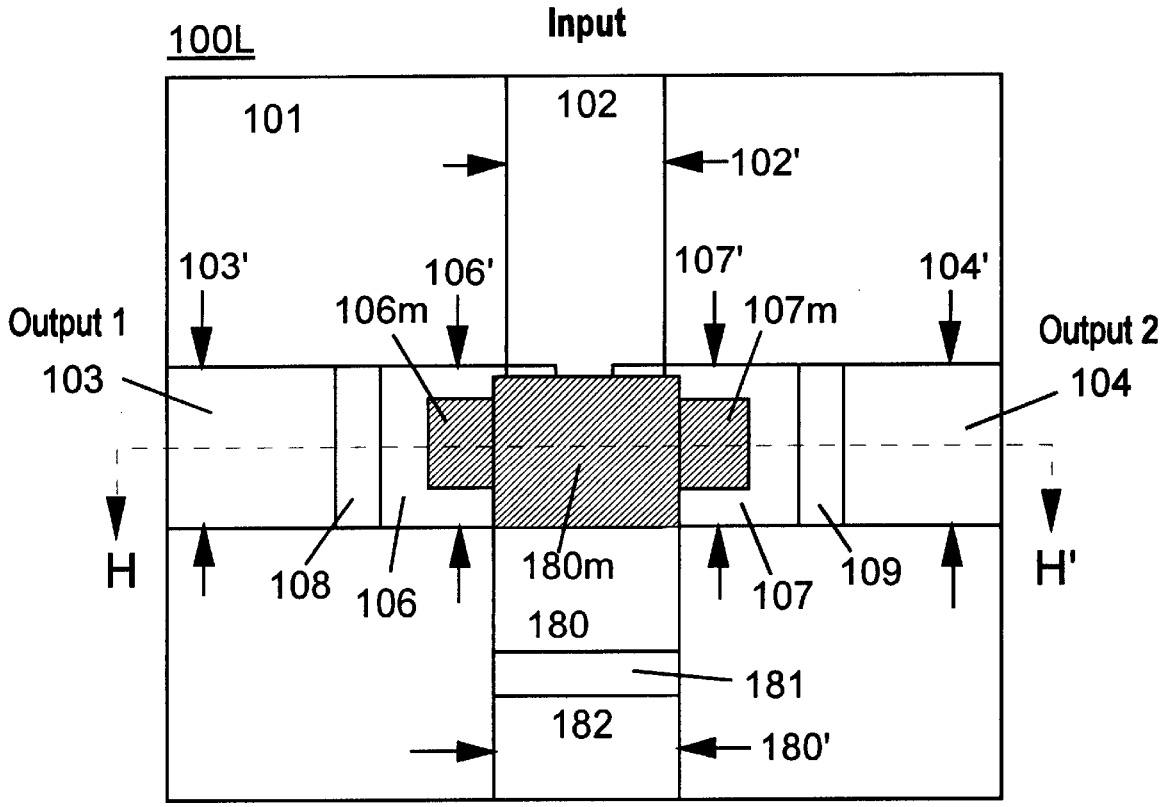
FIG. 9(*a*) shows a schematic top view of a double-throw miniature microwave switch (100L) with latching mechanism. The switch contains an input transmission line with an input permanent magnetic film, a first movable output cantilever with a first permanent magnetic film and connected to a first output transmission line, a second movable output cantilever with a second permanent magnetic film and connected to a second output transmission line, a third non-movable cantilever with a third permanent magnetic film. (*b*) A schematic cross-sectional view of the microwave switch taken along the line H–H' in FIG. 9(*a*).
Figure 9B:
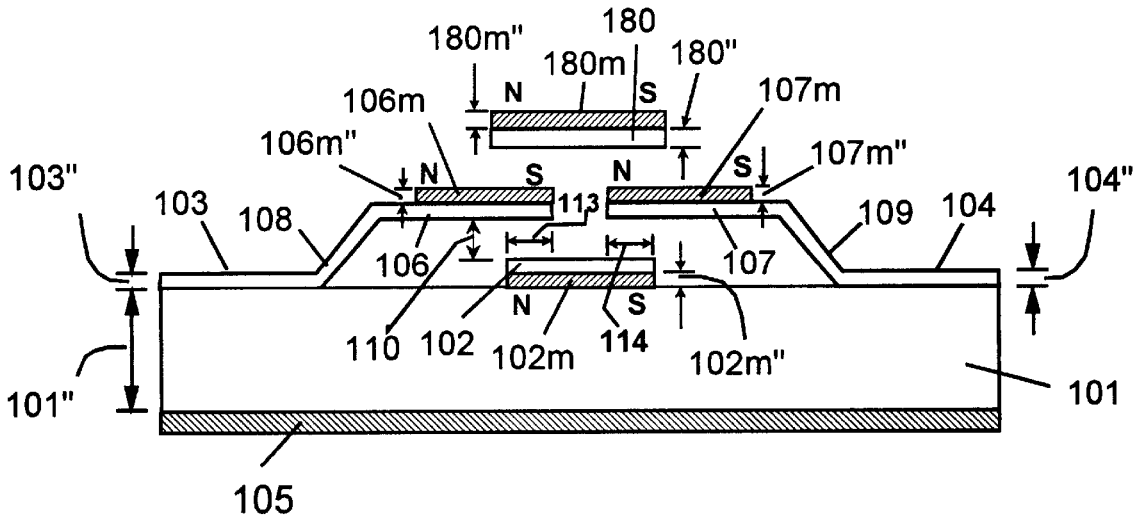
Figure 10A:
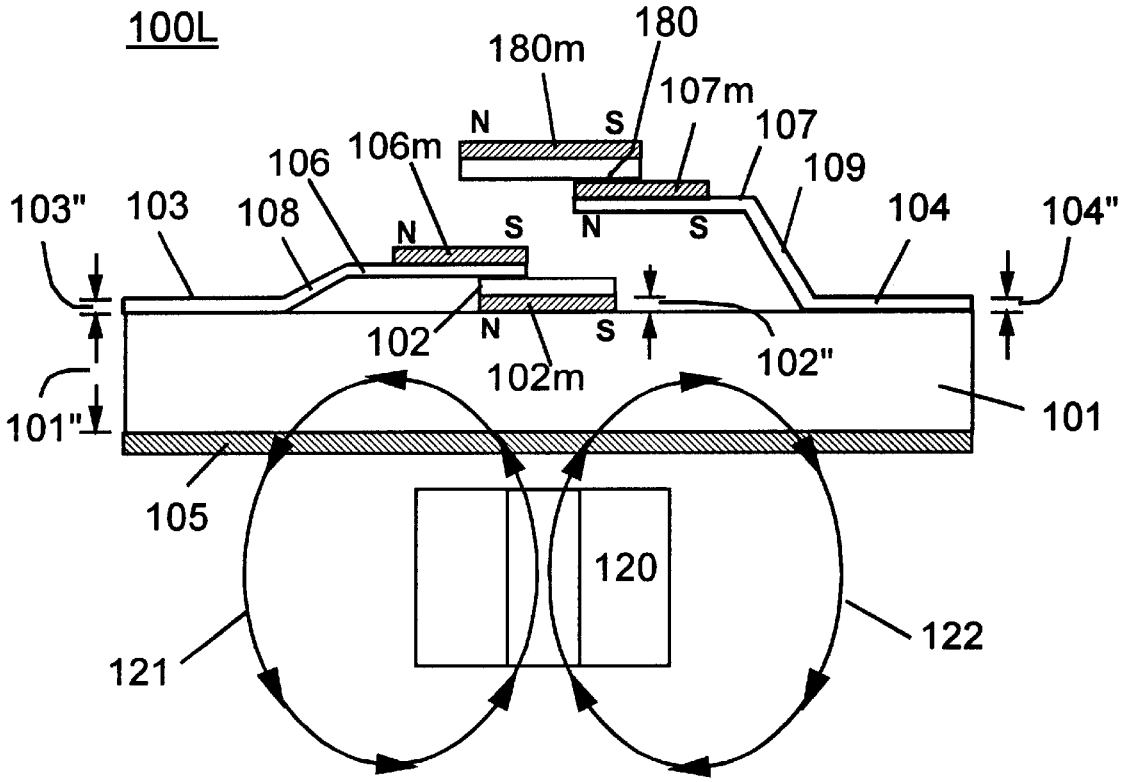
FIG. 10 Schematic cross-sectional views of the double-throw miniature microwave switch (100L), (*a*) for the case when an actuation current is applied to the electromagnet. The first output cantilever is pulled down to make electrical contact with the input transmission line whereas the second output cantilever is pushed up to the third non-movable cantilever. (*b*) Shows the switch in a latching state when the current to the electromagnet is disconnected. (*c*) Shows the case when an actuation current with an opposite direction is applied to the electromagnet and (*d*) displays the switch in another latching state when the current to the electromagnet is disconnected.
Figure 10B:
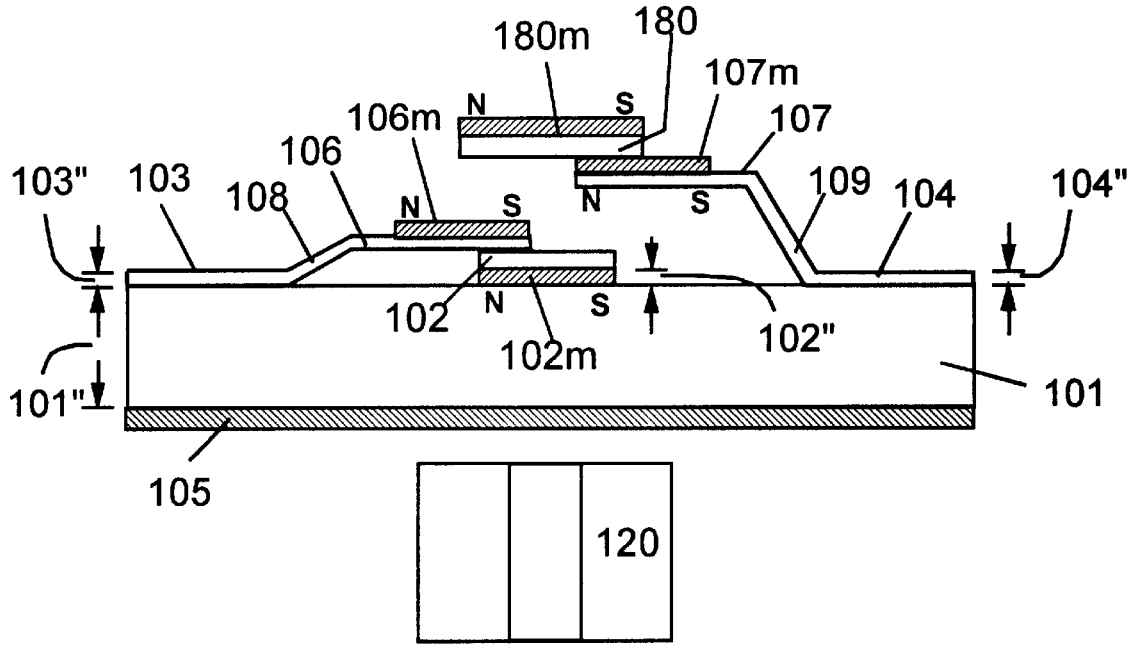
Figure 10C:
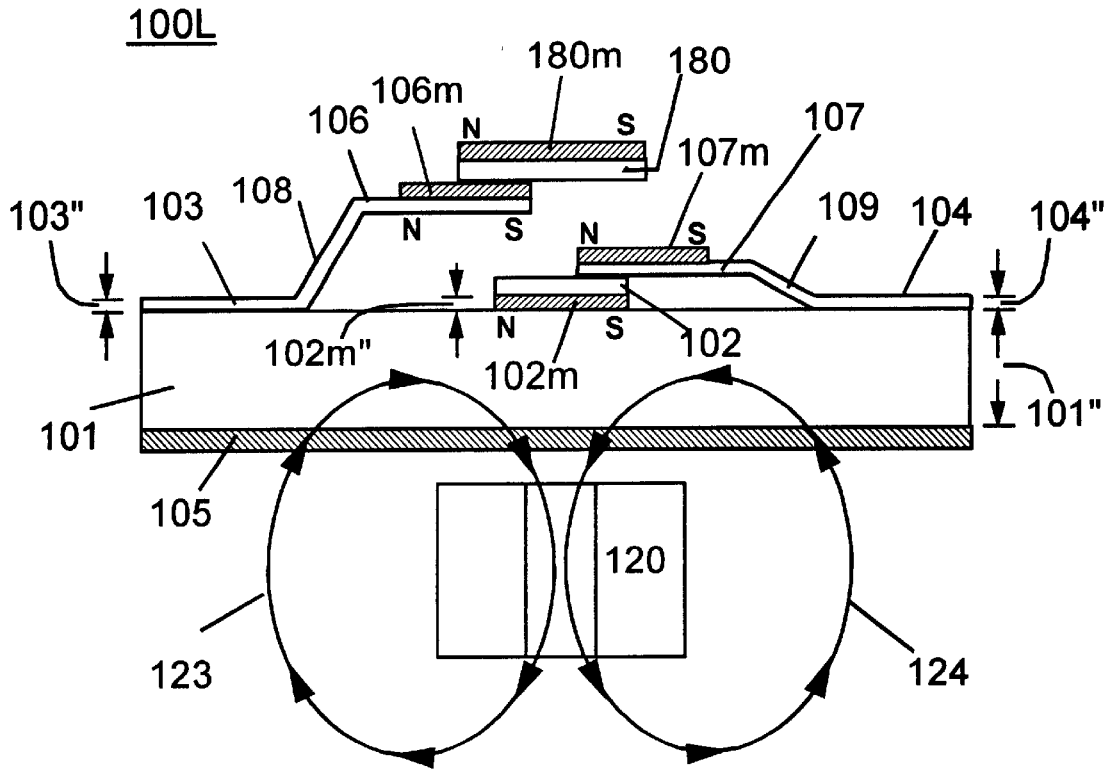
Figure 10D:
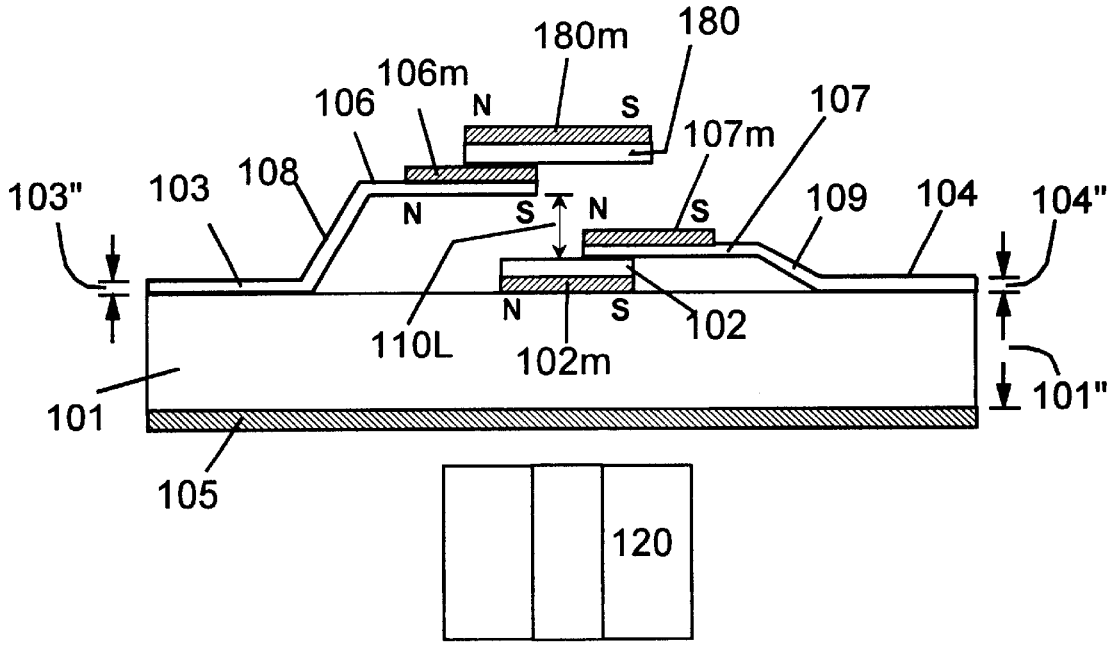
Figure 11A:
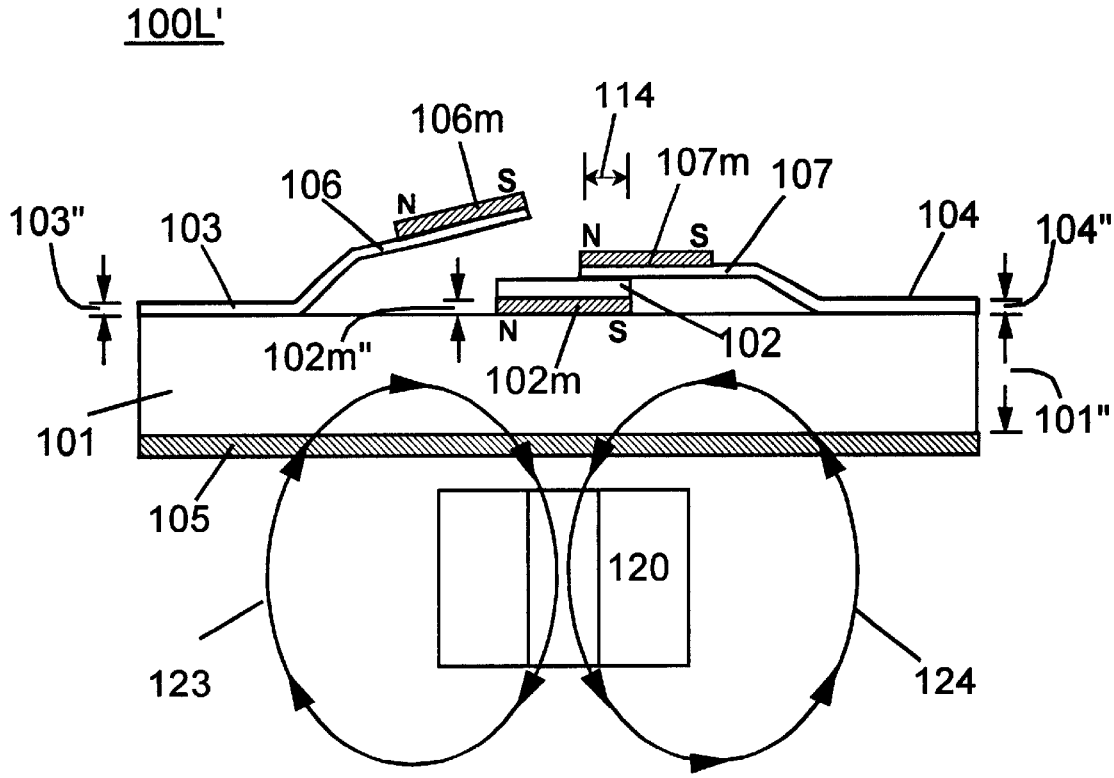
FIG. 11 Schematic cross-sectional views of a double-throw miniature microwave switch (100L') with latching mechanism, showing the cases (*a*) when an actuation current is applied to the electromagnet and (*b*) when the current to the electromagnet is disconnected. The second output cantilever is latched to the input transmission line and the first cantilever is in a normal position, forming a latched double-throw microwave switch.
Figure 11B:
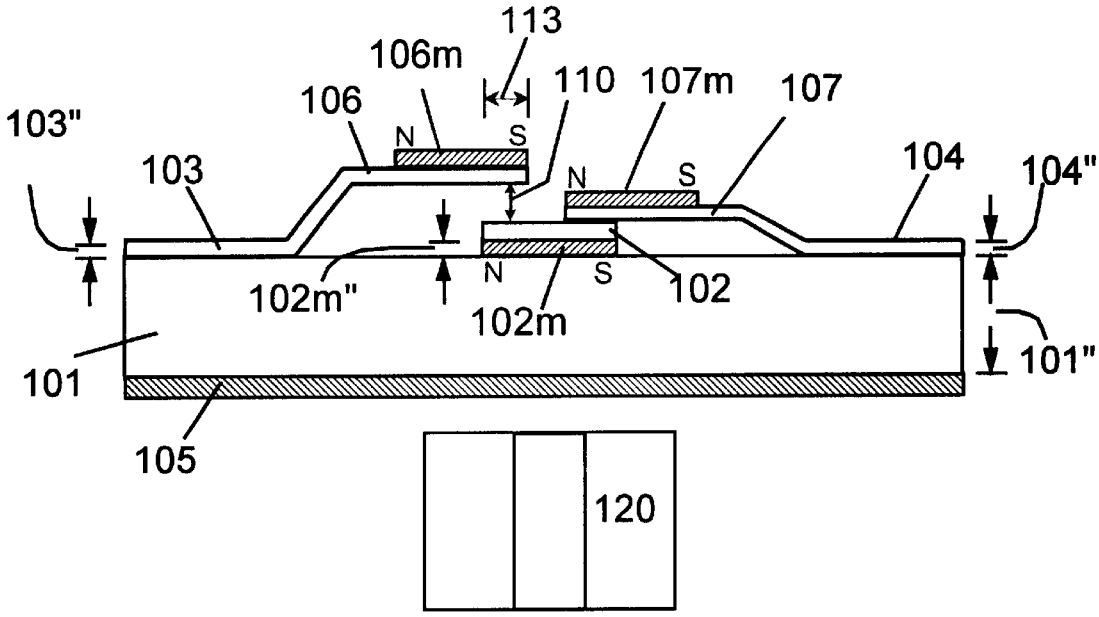
Figure 11C:
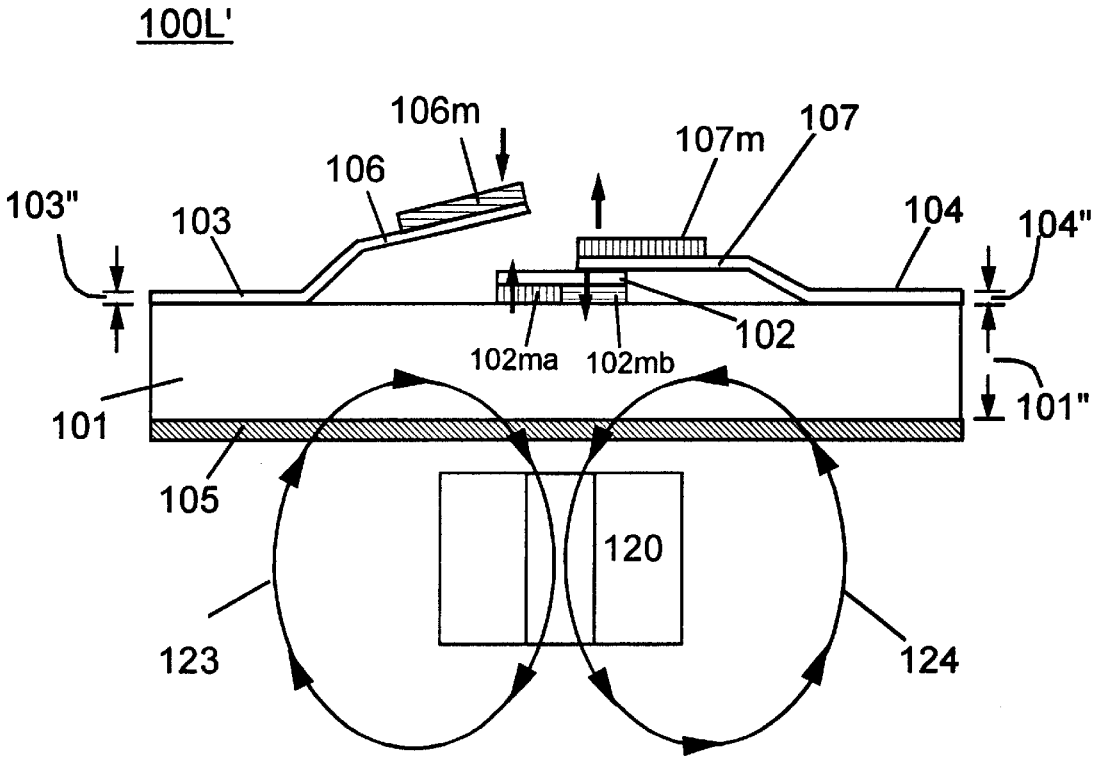
Figure 11D:
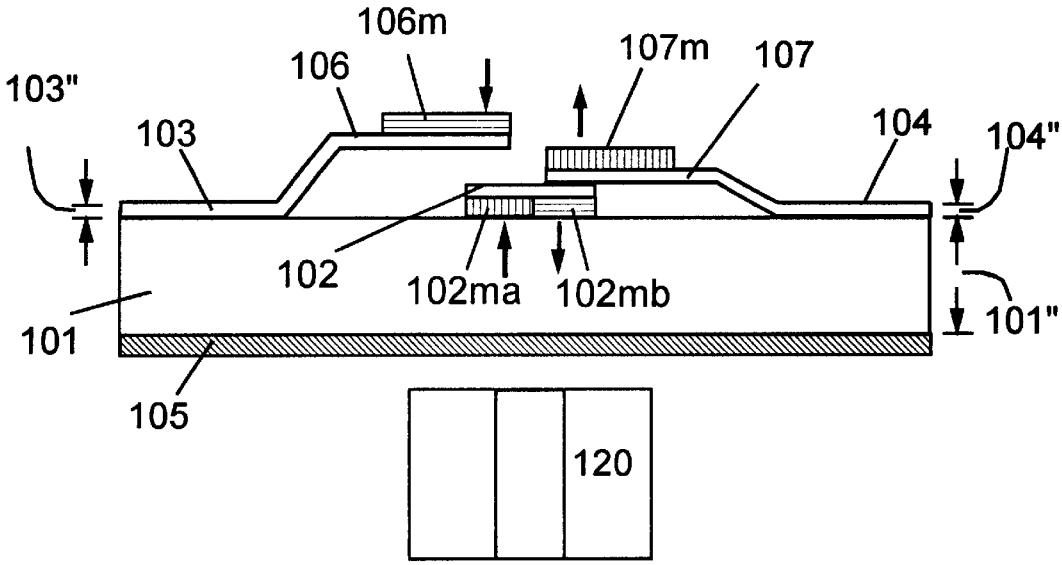
Figure 12A:
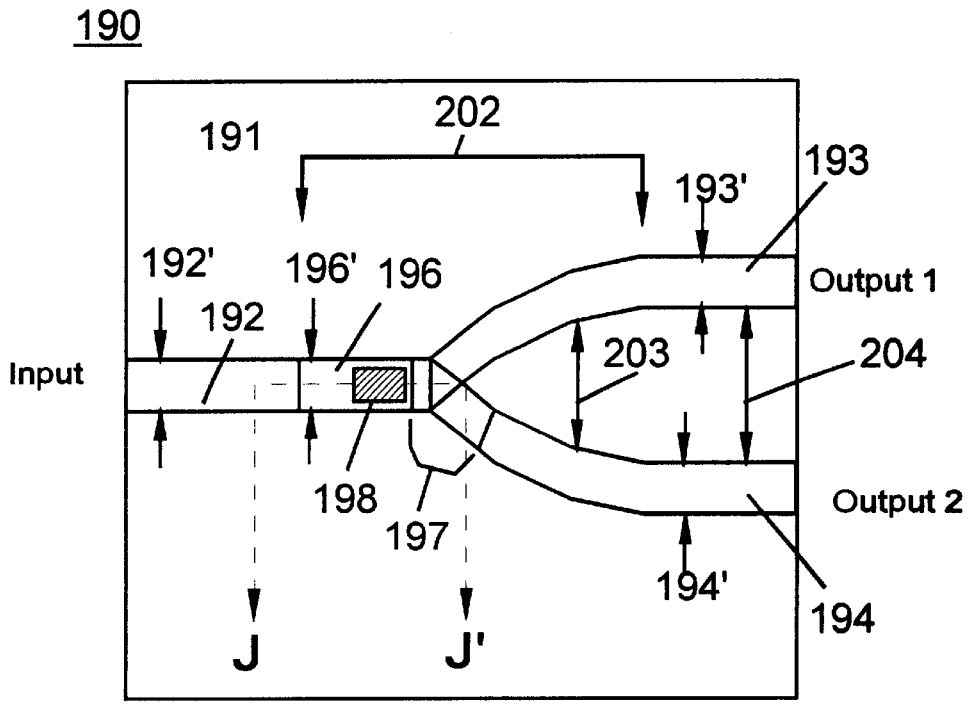
FIG. 12(*a*) Schematic top view of a double-throw miniature microwave switch (190) having an input transmission line connected to a movable input cantilever with an input permanent magnetic film, a first output transmission line and a second output transmission line connected to a second non-movable cantilever, showing a smooth transition region. (*b*) A enlarged schematic cross-sectional view of the microwave switch taken along the line J–J' in FIG. 12(*a*).
Figure 12B:
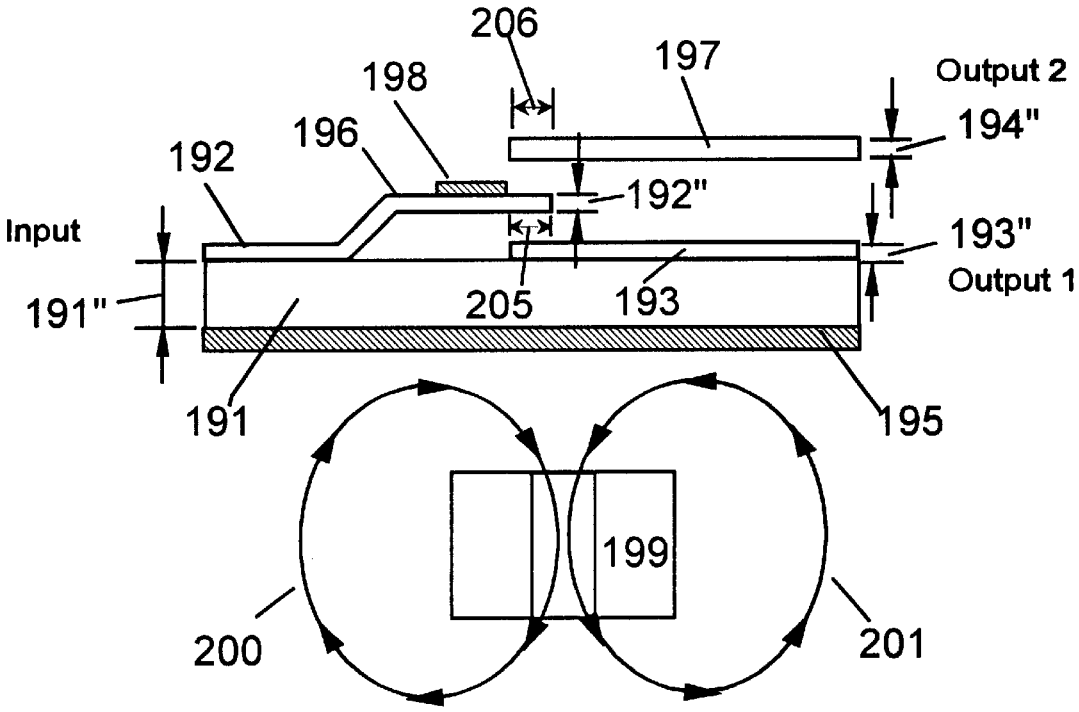
Figure 12C:
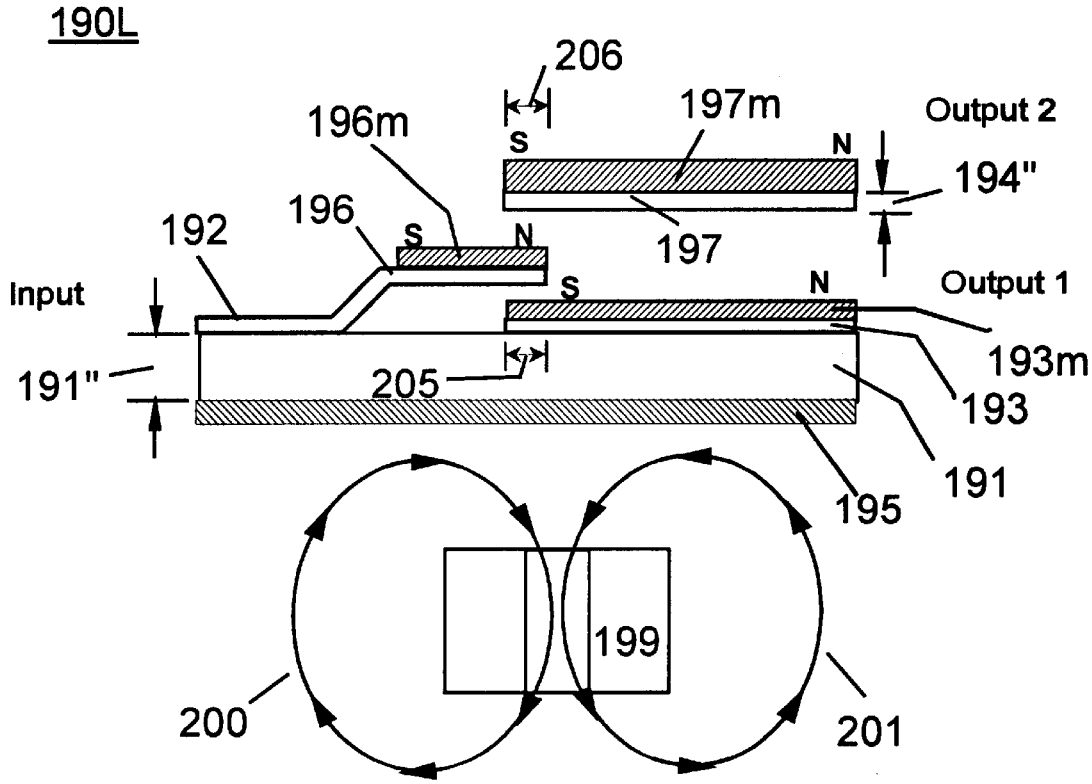
Figure 12D:
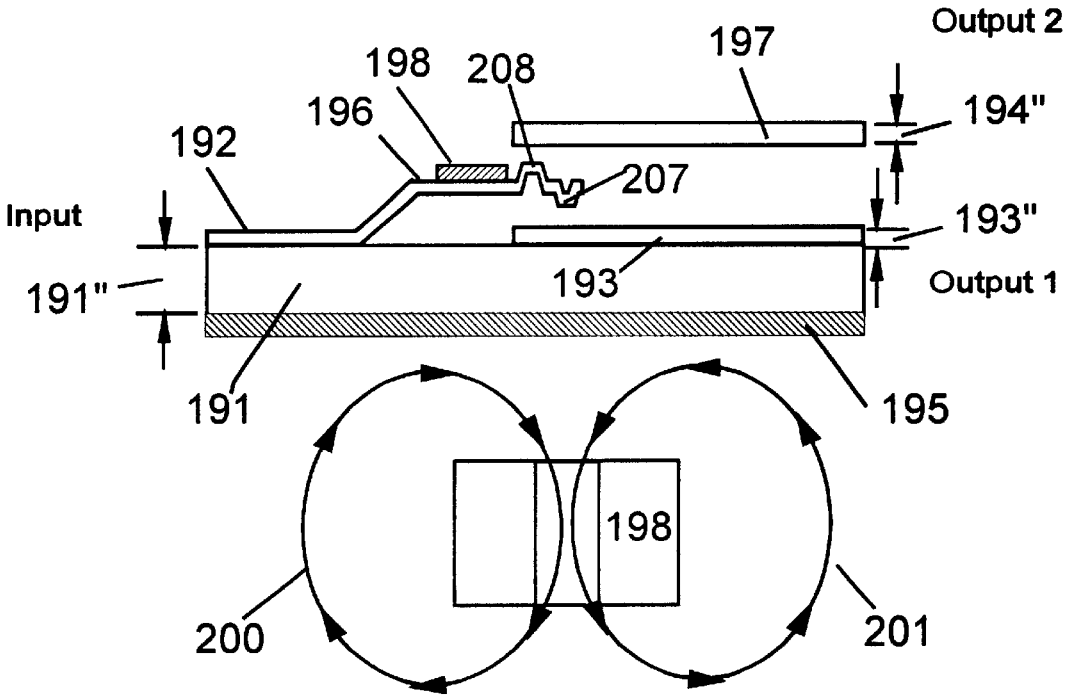

For microwave switching applications, it is highly desirable to have microwave switches with latching function so that the operating power can be minimized. Compared to miniature switches with electrostatic actuation, it is more difficult to achieve latching in the electromagnetically actuated counterparts. In another embodiment of this invention, an electromagnetically actuated switch with latching function as shown in FIG. 9 is provided. In this figure, all numerals have the same definition as those in FIG. 3 except for the items added to achieve the latching function, which are described as follows. As shown schematically in FIG. 9(*a*), this double-throw microwave switch (100L) is constructed on a substrate (101), with an input transmission line (102), a first output transmission line (103), a second output transmission lines (104) and a ground plane (105, in FIG. 9(*b*)). The first output transmission line (103) is connected to a first movable cantilever (106) through a first inclined potion (108) whereas the second output transmission line (104) is connected to a second movable cantilever (107) via a second inclined potion (109). In order to accomplish the latching function, a layer of input permanent magnetic film (102*m*, in FIG. 9(*b*)) is deposited under part of the input transmission line (102), a first cantilever permanent magnetic film (106*m*) is deposited on part of the first movable cantilever (106), whereas a second cantilever permanent magnetic film (107*m*) is deposited on part of the second movable cantilever (107). In addition to the above-described items, a third non-movable cantilever (180) raised by a third inclined potion (181) is deposited with an anchor (182) attached to the substrate (101) to achieve the latching function. A third cantilever permanent magnetic film (180*m*) is deposited on top of the third non-movable cantilever (180). Width (102') of the input transmission line (102), width (103') of the first output transmission line (103), width (104') of the second output transmission line (104), width (106') of the first movable cantilever (106) and width (107') of the second movable cantilever (107) are selected to give proper microwave properties. It is thus understood that these widths (102', 103', 104', 106' and 107') are selected according to the thickness (101", FIG. 9(*b*)) of the substrate (101), the dielectric constant of the substrate (101), the frequencies of operation and the characteristic impedance required. The third non-movable cantilever (180), the third inclined potion (181) and anchor (182) have the same width (180'), which is selected to give reliable latching effects.

As shown in FIG. 9(*b*), a cross-sectional view taken along H–H' in FIG. 9(*a*) details the relative positions of the input transmission line (102), the first output transmission line (103) with the first movable cantilever (106), the second output transmission line (104) with the second movable cantilever (107) and a third non-movable cantilever (180) for latching purpose. The vertical separation between the movable cantilevers (106, 107) and the input transmission line (102) is given by (110) while the overlaps between the movable cantilevers (106, 107) and the input transmission line (102) are (113, 114, in FIG. 9(*b*)). The thickness (103") of the first movable cantilever (106) and the first output transmission line (103), the thickness (106*m*") of the first cantilever permanent magnetic film (106*m*), the thickness (104") of the second movable cantilever (107) and the second output transmission line (104), and the thickness (107*m*") of the second cantilever permanent magnetic film (107*m*) are selected so that the first movable cantilever (106) and the second movable cantilever (107) are sufficiently flexible for actuation and do not interfere with the propagating of microwave signals. The thickness (180") of the third non-movable cantilever (180) is selected so that the third non-movable cantilever (180) including the third cantilever permanent magnetic film (180*m*) is sufficiently rigid and will not deform significantly when an actuation force is applied. The thickness (180*m*") of the third cantilever permanent magnetic film (180*m*) and the thickness (102*m*") of the input permanent magnetic film (102*m*) are selected so that they can provide sufficient magnetic moment for the latching function. As shown in FIG. 9(*b*), the permanent magnetic films (102*m*), (106*m*), (107*m*) and (180*m*) are magnetized horizontally and all in the same direction (pointing from N to S).

With the magnetization directions described above in mind, the operation of the double-throw miniature electromagnetic switch (100L) with latching function can be described easily in FIG. 10. In FIG. 10(*a*), the schematic cross-sectional view of the switch (100L) disclosed in FIG. 9 is shown for the case when a dc current is applied to the electromagnet (120). Due to the magnetic flux (121) going through the first cantilever permanent magnetic film (106*m*), the first cantilever permanent magnetic film (106*m*) will be attracted towards the electromagnet (120), so that the leading end of the first movable cantilever (106) will get in touch with the input transmission line (102). Since the direction of the magnetic flux (122) going through the second cantilever permanent magnetic film (107*m*) is opposite to that experienced by the first cantilever permanent magnetic film (106*m*), the second cantilever permanent magnetic film (107*m*) will experience a repulsion force and the second movable cantilever (107) will be pushed away from the input transmission line (102) and get in touch with the third non-movable cantilever (180).

Given the magnetization of the input permanent magnetic film (102*m*) and the first cantilever permanent magnetic film (106*m*) and the relative position of the two permanent magnetic films (102*m*, 106*m*), when the first movable cantilever (106) is actuated and moved to be near the input transmission line (102), an attraction force is present between the first cantilever permanent magnetic film (106*m*) and the input permanent magnetic film (102*m*). The above attraction force will be greater than the attraction force present between the first cantilever permanent magnet film (106*m*) and the third cantilever permanent magnetic film (180*m*) due to the distance difference. Hence, once actuated, the first movable cantilever (106) will be latched to the input transmission line (102) even when the magnetic flux (121) from the electromagnet (120) is switched off (see FIG. 10(*b*)). Similarly, due to the magnetization of the second cantilever permanent magnetic film (107*m*) and the third cantilever permanent magnetic film (180*m*) and the relative position of the two permanent magnetic films (107*m*, 180*m*), there will be an attraction force between the second cantilever permanent magnetic film (107*m*) and the third cantilever permanent magnetic film (180*m*) when the second movable cantilever (107) is actuated and moved to be near the third non-movable cantilever (180). The above force will be grater than the attraction force between the second cantilever permanent magnetic film (107*m*) and the input permanent magnetic film (102*m*) because of the distance difference. Hence, the second movable cantilever (107) will be latched to the third non-movable cantilever (180) even when the magnetic flux (122) from the electromagnet (120) is switched off (see FIG. 10(*b*)). Microwave signals from the input transmission line (102) will be guided to the first output transmission line (103) through the first movable cantilever (106) and will not be guided to the second output transmission line (104).

When the direction of the dc current to the electromagnet (120) is reversed, the magnetic flux (123, 124) will reverse as shown in FIG. 10(*c*)). In this case, the first cantilever permanent magnetic film (106*m*) will experience a repulsion force and the first movable cantilever (106) will be pushed away from the input transmission line (102). Whereas the second cantilever permanent magnetic film (107*m*) will experience an attracting force and the second movable cantilever (107) will be attracted to make contact with the input transmission line (102). When the first movable cantilever (106) is actuated and moved to be near the third non-movable cantilever (180), there will be an attraction force present between the first cantilever permanent magnetic film (106*m*) and the third cantilever permanent magnetic film (180*m*). The above attraction force will be greater than the attraction force present between the first cantilever permanent magnetic film (106*m*) and the input permanent magnetic film (102*m*) because of the distance difference. Due to the attraction force between the permanent magnetic films (106*m*, 180*m*), after the new actuation, the first movable cantilever (106) will be latched to the third non-movable cantilever (180) even when the dc current to the electromagnet (120) is switched off (see FIG. 10(*d*)). During above actuation, the second cantilever permanent magnetic film (107*m*) will be attracted towards the electromagnet (120). Therefore, the second movable cantilever (107) will move towards the input transmission line (102). Due to the magnetization of the second cantilever permanent magnetic film (107*m*) and the input permanent magnetic film (102*m*) and the relative position of the two (107*m*, 102*m*), there will be an attraction force between the second cantilever permanent magnetic film (107*m*) and the input permanent magnetic film (102*m*). The above force will be grater than the attraction force between the second cantilever permanent magnetic film (107*m*) and the third cantilever permanent magnetic film (180*m*). Hence, the second movable cantilever (107) will be latched to the input transmission line (102) even when the dc current to the electromagnet (120) is switched off (see FIG. 10(*d*)). Microwave signals from the input transmission line (102) will be guided through the second movable cantilever (107) to the second output transmission line (104) and will not be guided to the first output transmission line (103).

In order to ensure low resistance contact between the input transmission line (102) and the movable cantilevers (106, 107), it is preferable to create at least one recess region in the first movable cantilever (106) and to create at least one recess region in the second movable cantilever (107). In this way, the presence of any unwanted particles between the movable cantilevers (106, 107) and the substrate (101) or between the movable cantilevers (106, 107) and the input transmission line (102) will not have a detrimental effect on the operation. In addition, the pressure of contact between the input transmission line (102) and the movable cantilevers (106, 107) will be increased.

The amount of overlaps (113, 114) is determined by the desired minimum parasitic capacitances required for the overlapped regions when movable cantilevers (106, 107) are not in contact with the input transmission line (102). It is obvious that for fixed values of separation (110, in FIG. 9(*b*)) and widths (106', 107' in FIG. 9(*a*)) of the first and the second movable cantilevers (106, 107), the parasitic capacitance values are directly proportional to the amounts of overlaps (113, 114). The amount of overlaps (113, 114) of the switch (100L) is preferably to be as small as possible so that the effect of the overlaps (113, 114) on the frequencies of operation will be diminished. On the other hand, the amount of overlaps (113, 114) has to be large enough to ensure good electrical contact between the movable cantilevers (106, 107) and the input transmission line (102) and to ensure reliable latching function. The latching separation (110L, in FIG. 10(*d*)) in the latching state is much larger than the separation (110, in FIG. 9(*b*)) in normal position of the movable cantilevers (106, 107). Hence, the parasite capacitance of switch (100L) is expected to be smaller than that of the switch (100) without the latching function.

Although the miniature double-throw microwave switch (100L) with latching function disclosed in FIGS. 9 and 10 is preferable, a latching double-throw microwave switch without the third non-movable cantilever (180) is also feasible. In FIGS. 11(*a*) and 11(*b*), such a switch (100L') is demonstrated with all numerals having the same definition as those in FIG. 3 except for the items added to achieve the latching function. Similar to the switch (100L) disclosed in FIGS. 9 and 10, switch (100L') contains an input transmission line (102) with an input permanent magnetic film (102*m*), a first movable cantilever (106) with a first cantilever permanent magnetic film (106*m*) and connected to a first output transmission line (103), a second movable cantilever (107) with a second cantilever permanent magnetic film (107*m*) and connected to a second output transmission line (104). However, it does not contain a third non-movable cantilever. In FIG. 11(*a*) a schematic cross-sectional view shows the miniature double-throw microwave switch (100L') with a dc current applied to the electromagnet (120). Due to the magnetic flux (123) going through the first cantilever permanent magnetic film (106*m*), (106*m*) will experience a repulsion force and the first movable cantilever (106) will be pushed further away from the input transmission line (102). Since the direction of the magnetic flux (124) going through the second cantilever permanent magnetic film (107*m*) is opposite to that experienced by the first cantilever permanent magnetic film (106*m*), the second movable cantilever (107) will be attracted towards the input transmission line (102) and the leading end of the second movable cantilever (107) will get in touch with the input transmission line (102). Due to the magnetization of the second cantilever permanent magnetic film (107*m*) and the input permanent magnetic film (102*m*) and the relative position of the two (107*m*, 102*m*), there will be an attraction force between the second cantilever permanent magnetic film (107*m*) and the input permanent magnetic film (102*m*). Hence, the second movable cantilever (107) will be latched to the input transmission line (102) even when the dc current applied to the electromagnet (120) is switched off, as shown in FIG. 11(*b*). Without the magnetic flux (123), the first movable cantilever (106) will return to its normal position with a separation (110, in FIG. 11(*b*)) from the input transmission line (102). The attraction force between the input permanent magnetic film (102*m*) and the first cantilever permanent magnetic film (106*m*) are small due to the separation (110). Therefore the first movable cantilever (106) will not be attracted towards the input transmission line (102). Microwave signals from the input transmission line (102) will be guided through the second movable cantilever (107) to the second output transmission line (104) and will not be guided to the first output transmission line (103).

Since the separation (110) of the switch (100L') shown in FIG. 11(*b*) is smaller than the latching separation (110L) of the switch (100L) shown FIG. 10(*d*), the switch (100L') will have a larger parasitic capacitance value than the switch (110L). It is obvious that for a fixed value of separation (110) and widths (106', 107', in FIG. 3(*a*)) of the first and the second movable cantilevers (106, 107), the parasitic capacitance values are directly proportional to the amounts of overlaps (113, in FIG. 11(*b*)) and (114, in FIG. 11(*a*)). In order to reduce the parasitic capacitances, the amount of overlaps (113, 114) needs to be as small as possible provided that a good electrical contact and a reliable latching between the movable cantilevers (106, 107) and the input transmission line (102) are ensured.

It should be pointed out that for the miniature double-throw microwave switches described in FIGS. 9, 10, 11(*a*) and 11(*b*), the direction of magnetization of the input permanent magnetic film (102*m*), the first cantilever permanent magnetic film (106*m*), the second cantilever permanent magnetic film (107*m*), and the third cantilever permanent magnetic film (180*m*) are selected to be the same and are parallel to the surface of the substrate (101). However, other magnetization directions for the permanent magnetic films (102*m*, 106*m*, 107*m* and 180*m*) could be chosen. FIGS. 11(*c*) and 11(*d*) give an example of a miniature double-throw microwave latching switch with magnetization directions different from those in FIGS. 9, 10, 11(*a*) and 11(*b*). In FIG. 11(*c*), the input permanent magnetic film (102*m*) is separated into two parts: the first input permanent magnetic film (102*ma*) and the second input permanent magnetic film (102*mb*). The magnetization directions (indicated by arrows) of (102*ma*) and (102*mb*) are perpendicular to the surface of the substrate (101) and are opposite to each other. The magnetization directions of the first output permanent magnetic film (106*m*) and the second output permanent magnetic film (107*m*) are also perpendicular to the surface of the substrate (101) and are opposite to each other (see arrows). Because the vertical component of the magnetic fluxes (123, 124) at the top of the electromagnet (120) is along the magnetization direction of the first cantilever permanent magnetic film (106*m*) and is opposite to that of the second cantilever permanent magnetic film (107*m*), the second movable cantilever (107) will be attracted towards the input transmission line (102) and the first movable cantilever (106) will be pushed further away from the input transmission line (102). Once the second movable cantilever (107) is pulled down by the external magnetic field to be close to the second input permanent magnetic film (102*mb*), it will experience an attraction force from (102*mb*) due to the opposite magnetization direction. Therefore, the second movable cantilever (107) will be latched to the input transmission line (102) even when the dc current to the electromagnet (120) is switched off (see FIG. 11(*d*)). Due to a large distance between the first cantilever permanent magnetic film (106) and the first input permanent magnetic film (102*ma*), the first movable cantilever (106) will not be attracted to the input permanent magnetic film (102*ma*). Microwave signals from the input transmission line (102) will be guided through the second movable cantilever (107) to the second output transmission line (104) and will not be guided to the first output transmission line (103).

Although for FIGS. 9, 10 and 11, an input permanent magnetic film (102*m*) is deposited under the input transmission line (102), it should be pointed out that the latching double-throw miniature microwave switches (100L, 100L') could also be constructed with the input permanent magnetic film (102*m*) deposited on top of the input transmission line (102).

In another embodiment of the invention, an electromagnetically actuated double-throw microwave switch with a smooth transition region between the input transmission line and the output transmission lines is provided. As shown schematically in FIGS. 12(*a*) and 12(*b*), this microwave switch (190) is constructed on a substrate (191), with one input transmission line (192), a first output transmission line (193), a second output transmission line (194) and a ground plane (195, in FIG. 12(*b*)). The input transmission line (192) is connected to a movable input cantilever (196) whereas the second output transmission line (194) is connected to a non-movable output cantilever (197). The first output transmission line (193) is deposited directly on the substrate (191). The width (192') of the input transmission line (192), the width (196') of the movable input cantilever (196), the width (193') of the first output transmission line (193), the width (194') of the second output transmission line (194') and the non-movable output cantilever (197) are selected to give a proper microwave properties. It is understood that these widths (192', 193', 194' 196') are selected according to the thickness (191" in FIG. 12(*b*)) of the substrate (191), the dielectric constant of the substrate (191), the frequencies of operation and the characteristic impedance required. As shown in FIG. 12(*b*), where an enlarged cross-sectional view of part of the transition region taken along line J–J' in FIG. 12(*a*) is given, the relative positions of the input transmission line (192) and the movable input cantilever (196), the first output transmission line (193) and the non-movable output cantilever (197) are presented. The thickness (192") of the movable input cantilever (196) and the input transmission line (192) is selected to be substantially smaller than the thickness (194") of the non-movable output cantilever (197) and the second output transmission line (194) so that the non-movable output cantilever (197) is rigid whereas the movable input cantilever (196) is relatively flexible. The non-movable output cantilever (197) is made to be rigid so that it will not deform significantly when an actuation force is applied whereas the movable input cantilever (196) is made to be relatively flexible so that it can move upwards or downwards when an actuation force is applied. The thickness of the first output transmission line (193) is given by (193") in FIG. 12(*b*). A permanent magnetic film (198) is deposited on the movable input cantilever (196) and magnetized in such a way when an electromagnet (199) is activated to generate magnetic flux (200, 201) there is an attracting force on the permanent magnetic film (198). Hence, the movable input cantilever (196) will be attracted towards the first output transmission line (193) and to make contact with it. When the direction of the flux (200, 201) is reversed, there will be a repulsion force so that the movable input cantilever (196) will be pushed away from the first output transmission line (193) towards the non-movable output cantilever (197) and to make contact with it. Hence, dependent on the position of the movable input cantilever (196), microwave signals applied to the input transmission line (192) can propagate to either the first output transmission line (193) or the second output transmission line (194) through the non-movable output cantilever (197), forming a double-throw microwave switch.

For the switching of microwave signals at very high frequencies, such as more than 10 GHz, it is required to have more uniform and streamline distribution of the transmission lines, even in the transition region where the actuated movable input cantilever (196) makes contact with the first output transmission line (193) and the non-movable output cantilever (197). As seen in FIG. 12(*a*), the disclosed double-throw microwave switch (190) has a smooth-out transition region (202) and no sharp corner exists in this switch (190) Inside the contact area, the projection of the non-movable output cantilever (197) overlaps the first output transmission line (193). Once outside the contact area, the output transmission lines (193, 194) start to split up and are separated by a variable distance (203), which increases gradually until reaching its maximum value (204). When the movable input cantilever (196) is actuated to make electrical contact with the first output transmission line (193), microwave signals will propagate from the input transmission line (192) through the transition region (202) towards the first output transmission line (193). Due to the smoothed transition region (202), the reflection and losses for the propagating microwaves will be minimized.

The amount of overlap (205, in FIG. 12(*b*)) between the movable input cantilever (196) and the first output transmission line (193) is determined by the desired minimum parasitic capacitances required for the overlapped region when the movable input cantilever (196) is not in contact with the first output transmission line (193). Similarly, the amount of overlap (206, in FIG. 12(*b*)) between the movable input cantilever (196) and the non-movable output cantilever (197) is determined by the desired minimum parasitic capacitances required for the overlapped region when the movable input cantilever (196) is not in contact with the non-movable output cantilever (197). The overlaps (205, 206) of the switch are preferably to be small so that the effect of the overlaps (205, 206) on the frequencies of operation will be minimized. On the other hand, the overlaps (205, 206) have to be large enough to ensure good electrical contact between the movable input cantilever (196) and the first output transmission line (193), and between the movable input cantilever (196) and the non-movable output cantilever (197).

To add latching function to the microwave switch (190) disclosed in FIGS. 12(*a*) and 12(*b*), an input permanent magnetic film (196*m*) is added on the movable input cantilever (196), a first output permanent magnetic film (193*m*) on part of the first output transmission line (193), and a second output permanent magnetic film (197*m*) on the non-movable output cantilever (197), as shown in FIG. 12(*c*), where all numerals having the same definition as those in FIGS. 12(*a*) and (*b*) except for the items added to achieve the latching function. It is noted that the first output permanent magnetic film (193*m*) could also be deposited under the first output transmission line (193) and the second output permanent magnetic film (197*m*) could also be deposited under the non-movable output cantilever (197). The input permanent magnetic film (196*m*) forms part of the input cantilever (196) whereas the second output permanent magnetic film (197*m*) forms part of the non-movable output cantilever (197). The input permanent magnetic film (196*m*), the first output permanent magnetic film (193*m*) and the second output permanent magnetic film (197*m*) are preferably magnetized simultaneously so that magnetization of (196*m*, 193*m*, 197*m*) are substantially in the same direction (indicated by N and S in FIG. 12(*c*)).

When the electromagnet (199) is activated to generate magnetic flux (200, 201), there is an attracting force on the input permanent magnetic film (196*m*). Hence, the movable input cantilever (196) will be attracted towards the first output transmission line (193) and to make contact with it. Due to the magnetization of the input permanent magnetic film (196*m*) and the first output permanent magnetic film (193*m*) and the relative position of the two, there will be a magnetic attracting force between the input permanent magnetic film (196*m*) and the first output permanent magnetic film (193*m*). This will result in a latching even when the dc current applied to the electromagnet (199) is disconnected. Since there is a separation between the input permanent magnetic film (196*m*) and the second output permanent magnetic film (197*m*) when the movable input cantilever (196) is pulled to the first output transmission line (193), the attracting force between (196*m*) and (197*m*) will be weaker than that between (196*m*) and (193*m*). When the direction of the magnetic fluxes is reversed, there will be a repulsion force so that the movable input cantilever (196) will be pushed away from the first output transmission line (193) and towards the non-movable output cantilever (197) and to make contact with it. Due to the magnetization of the input permanent magnetic film (196*m*) and the second output permanent magnetic film (197*m*) and the relative position of the two, there will be a magnetic attracting force between the input permanent magnetic film (196*m*) and the second output permanent magnetic film (197*m*). This will result in a latching even when the dc current applied to the electromagnet (199) is disconnected. Since there is a separation between the input permanent magnetic film (196*m*) and the first output permanent magnetic film (193*m*) when the movable input cantilever (196) is pushed to the non-movable output cantilever (197), the attracting force between (196*m*) and (193*m*) will be much weaker than that between (196*m*) and (197*m*). Hence, dependent on the position of the movable input cantilever (196), microwave signals applied to the input transmission line (192) can propagate to either the first output transmission line (193) or the second output transmission line (194) through the non-movable output cantilever (197), forming a double-throw microwave switch with latching mechanism. It is noted that in order to achieve a microwave switch with satisfactory performance, the magnetic moment of the first output permanent magnetic film (193*m*) will have to be close to that of the second output permanent magnetic film (197*m*). This can be achieved by controlling the mass, geometry, magnetization of the first output permanent magnetic film (193*m*) and the second output permanent magnetic film (197*m*). The overlaps (205, 206) of the switch (190L) are preferably to be small so that the effect of the overlaps (205, 206) on the frequencies of operation will be minimized. However, the value of overlaps (205, 206) has to be large enough to ensure good electrical contact between the movable input cantilever (196) and the first output transmission line (193) and between the movable input cantilever (196) and the non-movable output cantilever (197) and to ensure reliable latching function.

In order to ensure low resistance contact between the movable input cantilever (196) and the first output transmission line (193), it is preferable to create at least one recess region (207, in FIG. 12(*d*)) in the movable input cantilever (196) with the tip of the recess region (207) facing down. In this way, the presence of fine particles between the movable input cantilever (196) and the first output transmission line (193) will not have a detrimental effect on the operation. Similarly, in order to ensure low resistance contact between the movable input cantilever (196) and the non-movable output cantilever (197), which connected to the second output transmission line (194), it is preferable to create at least one recess region (208, in FIG. 12(*d*)) in the movable input cantilever (196) with the tip of the recess region (208) facing up. In this way, the presence of fine particles between the movable input cantilever (196) and the non-movable output cantilever (197) will not have a detrimental effect on the operation. In addition, because of the recess regions (207, 208) in the movable input cantilever (196), the pressure of contact between the movable input cantilever (196) and the first output transmission line (193) and between the movable input cantilever (196) and the non-movable output cantilever (197) will be increased.

The foregoing description is illustrative of the principles of the present invention. The preferred embodiments may be varied in many ways while maintaining the spirit of this invention. For instance, in addition to microstrip structure, the double-throw switches and switch arrays may be fabricated in a form of coplanar waveguide (CPW), in a form of stripline or other structures. Therefore, all modifications and extensions are considered to be within the scope and spirit of the present invention.

The embodiments of the invention in which an exclusive property or privilege is claimed are defined as follows:

1. A miniature double-throw electromagnetically actuated microwave switch comprising:

a dielectric substrate having at least one input transmission line, a first output transmission line and a second output transmission line deposited on a front surface of said dielectric substrate for propagating and routing of microwave signals;

a first cantilever connected to said first output transmission line and with a projection overlapping at least a part of said input transmission line;

a second cantilever connected to said second output transmission line and with a projection overlapping at least a part of said input transmission line;

a first permanent magnetic film deposited on a part of a top surface of said first cantilever for actuating said first cantilever;

a second permanent magnetic film deposited on a part of a top surface of said second cantilever for actuating said second cantilever;

an electromagnetic coil under said dielectric substrate for actuating said first cantilever and second cantilever.

2. A miniature double-throw electromagnetically actuated microwave switch as defined in claim 1, further comprising means to supply an electric current to said electromagnetic coil, magnitude of said electric current is greater than a pull-down threshold current, to actuate said first cantilever, causing electric connection between said input transmission line and first output transmission line and to de-actuate said second cantilever, causing electric isolation between said input transmission line and said second output transmission line.

3. A miniature double-throw electromagnetically actuated microwave switch as defined in claim 1, further comprising means to supply a reverse electric current to said electromagnetic coil, magnitude of said electric current is greater than a pull-down threshold current, to actuate said second cantilever, causing electric connection between said input transmission line and said second output transmission line and to de-actuate said first cantilever, causing electric isolation between said input transmission line and first output transmission line.

4. A miniature double-throw electromagnetically actuated microwave switch as defined in claim 1, wherein said first cantilever and second cantilever are selected from a group of a metal membrane, and a dielectric membrane with conducting coatings on both a front surface and a back surface.

5. A miniature double-throw electromagnetically actuated microwave switch as defined in claim 1, wherein said input transmission line and output transmission lines are patterned conducting thin films with thickness between 0.5 $\mu$m and 10 $\mu$m.

6. A miniature double-throw electromagnetically actuated microwave switch as defined in claim 1, wherein said first cantilever has at least one recess regions, at least one of said recess regions have projection overlapping said input transmission line, and said second cantilever has at least one recess regions, at least one of said recess regions have projection overlapping said input transmission line, to minimize effects of particles present under said first cantilever and second cantilever.

7. A miniature double-throw electromagnetically actuated microwave switch as defined in claim 1, wherein end region of said input transmission line is tapered so that the outer angles made with said first cantilever and said second cantilever are not abrupt, said first cantilever has an protruding region so that inner angle made with said input transmission line when in contact is not abrupt, said second cantilever has an protruding region so that inner angle made with said input transmission line when in contact is not abrupt.

8. A miniature double-throw electromagnetically actuated microwave switch as defined in claim 1, further comprising a permanent magnetic film on a portion of said input transmission line for latching of said first cantilever when actuated and for latching of said second cantilever when actuated.

9. A miniature double-throw electromagnetically actuated microwave switch as defined in claim 8, further comprising a non-movable third cantilever with a third permanent magnetic film for latching of said first cantilever when de-actuated and for latching of said second cantilever when de-actuated.

10. A miniature double-throw electromagnetically actuated microwave switch with latching mechanism comprising:

a dielectric substrate having an input transmission line with a movable cantilever;

a first output transmission line;

a second output transmission line with a non-movable cantilever for propagating and routing of microwave signals;

an input permanent magnetic film on at least part of said movable cantilever;

a first output permanent magnetic film on part of said first output transmission line for latching of said movable cantilever when actuated;

a second output permanent magnetic film on part of said second output transmission line for latching of said movable cantilever when de-actuated; and an electromagnetic coil under said dielectric substrate for actuating said movable cantilever.

11. A miniature double-throw electromagnetically actuated microwave switch with latching mechanism as defined in claim 10, further comprising means to supply an electric current to said electromagnetic coil, magnitude of said electric current is greater than a pull-down threshold current, to actuate said movable cantilever, causing electric connection between said input transmission line and first output transmission line and electric isolation between said input transmission line and second output transmission line.

12. A miniature double-throw electromagnetically actuated microwave switch with latching mechanism as defined in claim 10, further comprising means to supply a reverse electric current to said electromagnetic coil, magnitude of said electric current is greater than a push-up threshold current, to de-actuate said movable cantilever, causing electric isolation between said input transmission line and first output transmission line and electric connection between said input transmission line and second output transmission line.

13. A miniature double-throw electromagnetically actuated microwave switch with latching mechanism as defined in claim 10, wherein said movable cantilever has at least two recess regions, at least one of said recess regions have projection overlapping said first transmission line, and at least one of said recess regions have projection overlapping said non-movable cantilever to minimize effects of unwanted particles present under and on said movable cantilever.

14. A miniature double-throw electromagnetically actuated microwave switch with latching mechanism as defined in claim 10, further comprising a smooth transition region between said input transmission line and said first and second output transmission lines to avoid sharp corners.

15. A miniature double-throw electromagnetically actuated microwave switch with latching mechanism as defined in claim 10, wherein said movable cantilever is selected from a group of a metal membrane, and a dielectric membrane with conducting coatings on both a front surface and a back surface.

16. A miniature double-throw electromagnetically actuated microwave switch with latching mechanism as defined in claim 10, further comprising a conducting film on a backside of said dielectric substrate.

* * * * *